US011840844B2

(12) United States Patent
Lee et al.

(10) Patent No.: US 11,840,844 B2
(45) Date of Patent: Dec. 12, 2023

(54) UNIT BRACKET, BRACKET AND BRACKET CONSTRUCTION METHOD FOR ATTACHING TO BASE MATERIAL AND WALL USING THE SAME

(71) Applicant: SAMWON ACT CO., LTD., Busan (KR)

(72) Inventors: Kyung Wook Lee, Ansan-si (KR); Kyung Yul Lee, Bucheon-si (KR); Hong Seok Han, Siheung-si (KR)

(73) Assignee: SAMWON ACT CO., LTD., Busan (KR)

( * ) Notice: Subject to any disclaimer, the term of this patent is extended or adjusted under 35 U.S.C. 154(b) by 12 days.

(21) Appl. No.: 17/371,260

(22) Filed: Jul. 9, 2021

(65) Prior Publication Data

US 2022/0195737 A1 Jun. 23, 2022

(30) Foreign Application Priority Data

Dec. 22, 2020 (KR) ..... 10-2020-0180693

(51) Int. Cl.
*E04F 13/08* (2006.01)

(52) U.S. Cl.
CPC ..... *E04F 13/0833* (2013.01); *E04F 13/0885* (2013.01)

(58) Field of Classification Search
CPC . E04F 13/0833; E04F 13/0885; F16B 5/0012; F16B 5/0016; F16B 21/084; F16B 21/086
USPC ..... 52/177, 180, 181, 403.1, 480, 588.1
See application file for complete search history.

(56) References Cited

U.S. PATENT DOCUMENTS 3,413,690 A * 12/1968 Pearson ..... F16B 21/086 411/508
3,438,312 A * 4/1969 Becker ..... E04F 15/10 428/53
5,170,601 A * 12/1992 Geisen ..... E04F 15/02172 52/177
5,274,887 A * 1/1994 Fudaki ..... A44B 11/28 24/600.9
5,323,575 A * 6/1994 Yeh ..... E04F 15/02 52/390
5,616,389 A * 4/1997 Blatz ..... E04F 15/105 428/44

(Continued)

FOREIGN PATENT DOCUMENTS

KR 10-2006-0042558 A 5/2006
KR 10-1733212 B1 3/2017

(Continued)

*Primary Examiner* — Brian E Glessner
*Assistant Examiner* — Adam G Barlow
(74) *Attorney, Agent, or Firm* — QUANTUM PATENT LAW FIRM; Seongyoune Kang

(57) ABSTRACT

The present disclosure has the following configurations. The present disclosure relates to a unit bracket in a square shape, in which outer surfaces of four surfaces of the unit bracket are formed with locking projections configured to insert a metal or plastic panel, and a center portion of the unit bracket is formed with a mesh part to be formed such that the bonding is possible at a vertical tensile strength and a horizontal tensile strength having desired forces even if the unit bracket and a wall or a base material are bonded with an adhesive, in order to bond the unit bracket to the wall or the base material.

8 Claims, 19 Drawing Sheets

(56) References Cited

U.S. PATENT DOCUMENTS 5,628,160 A * 5/1997 Kung ..... E04F 15/105 52/177
D415,581 S * 10/1999 Bertolini ..... D25/156
6,422,781 B1 * 7/2002 Ofcharsky ..... H02G 3/086 403/309
6,467,224 B1 * 10/2002 Bertolini ..... E04F 15/043 52/177
6,694,691 B2 * 2/2004 Ku ..... E04F 15/087 52/480
6,751,912 B2 * 6/2004 Stegner ..... E01C 5/20 52/177
6,802,159 B1 * 10/2004 Kotler ..... E04F 15/105 52/592.1
6,857,242 B2 * 2/2005 He ..... E04F 15/022 52/480
7,021,019 B2 * 4/2006 Knauseder ..... E04F 15/04 24/297
7,340,865 B2 * 3/2008 Vanderhoef ..... E04F 15/02194 52/177
7,543,417 B2 * 6/2009 McIntosh ..... E04F 15/082 52/177
7,698,859 B2 * 4/2010 Sansano Marti . E04F 15/02194 52/302.1
D618,368 S * 6/2010 Jenkins ..... D25/156
7,748,177 B2 * 7/2010 Jenkins ..... E04B 5/43 52/592.1
7,779,602 B2 * 8/2010 Collison ..... E04F 15/043 52/177
7,908,802 B2 * 3/2011 Frederiksen ..... E01C 5/20 52/177
8,186,116 B2 * 5/2012 Anderson ..... E01C 5/001 52/592.1
8,225,566 B2 * 7/2012 Prevost ..... E01C 13/08 52/302.1
8,539,727 B2 * 9/2013 Lui ..... E04F 15/02 52/384
8,833,007 B2 * 9/2014 Tillery ..... E04F 15/22 52/177
8,919,054 B2 * 12/2014 Tillery ..... E04F 15/02038 52/177
9,618,027 B1 * 4/2017 Gold ..... F16B 19/002
9,841,041 B1 * 12/2017 Santillan Gutierrez ..... B60R 13/0206
10,279,560 B2 * 5/2019 Evans Hurson ..... E04F 15/107
11,060,301 B2 * 7/2021 Neill ..... E04F 15/02183
11,156,005 B2 * 10/2021 Schneider ..... E04B 1/003
11,319,711 B2 * 5/2022 Lee ..... E04F 13/123
11,332,945 B2 * 5/2022 Jarmey ..... E04F 15/02183
2002/0189176 A1 * 12/2002 Stegner ..... E04F 15/105 52/177
2003/0061772 A1 * 4/2003 Bertolini ..... E04F 15/043 52/177
2003/0177728 A1 * 9/2003 Ku ..... E04F 15/022 52/403.1
2005/0034403 A1 * 2/2005 Chen ..... E04F 15/02194 52/578
2006/0070314 A1 * 4/2006 Jenkins ..... E01C 13/045 52/177
2006/0260223 A1 * 11/2006 Wang ..... E04F 15/087 52/177
2008/0052986 A1 * 3/2008 Son ..... A63C 19/04 47/31.1
2009/0077918 A1 * 3/2009 Ban ..... E01C 5/005 52/588.1
2009/0139159 A1 * 6/2009 Hill ..... B32B 9/045 52/177
2009/0139160 A1 * 6/2009 Hill ..... B32B 3/10 52/177
2009/0266019 A1 * 10/2009 McIntosh ..... E04F 15/02044 52/415
2009/0266022 A1 * 10/2009 Lin ..... E04F 15/10 52/506.1
2010/0088982 A1 * 4/2010 Fogli ..... E04F 13/0862 52/177
2010/0287858 A1 * 11/2010 Israeli ..... E04B 1/61 52/704
2010/0300027 A1 * 12/2010 Bravo ..... E04F 15/087 52/311.1
2011/0023389 A1 * 2/2011 Myers ..... E04F 15/105 52/173.1
2011/0036032 A1 * 2/2011 Smith ..... E04F 13/185 264/129
2011/0061330 A1 * 3/2011 Vanderhoef ..... E04F 15/105 52/588.1
2011/0265411 A1 * 11/2011 Lai ..... E04F 15/02194 52/403.1
2012/0085043 A1 * 4/2012 Jenkins ..... E04F 15/22 52/177
2012/0117910 A1 * 5/2012 Chuang ..... A47B 96/20 52/588.1
2012/0240363 A1 * 9/2012 Lee ..... B60R 13/02 24/297
2013/0167458 A1 * 7/2013 Cerny ..... E04F 15/10 52/177
2015/0075092 A1 * 3/2015 Moller, Jr. ..... E04F 15/02038 52/177
2015/0284965 A1 * 10/2015 Hurson ..... B32B 37/24 156/60
2016/0236592 A1 * 8/2016 Peniche ..... F16B 2/22
2019/0072120 A1 * 3/2019 Santillan Gutierrez .. F16B 2/22
2020/0200204 A1 * 6/2020 Kawaguchi ..... F16B 21/086
2020/0340256 A1 * 10/2020 Lee ..... E04F 15/04
2021/0140456 A1 * 5/2021 Zimmermann ..... B62J 15/02

FOREIGN PATENT DOCUMENTS

KR 10-1947754 B1 5/2017
KR 10-2019-0084216 A 7/2019
KR 10-2103540 B1 7/2019
KR 10-2152880 B1 7/2019
KR 10-2074769 B1 8/2019

* cited by examiner

[FIG. 1A]
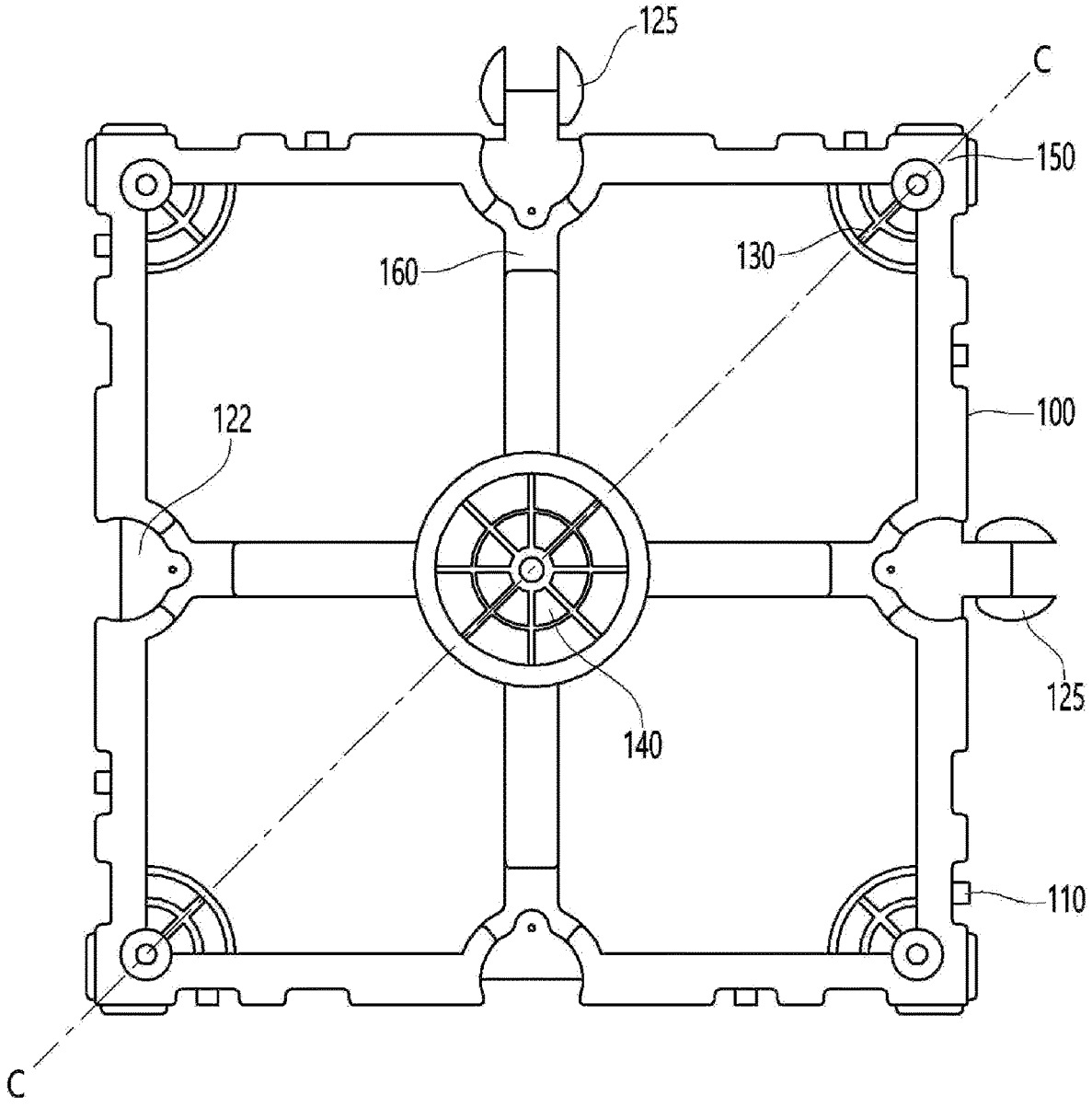

[FIG. 1B]
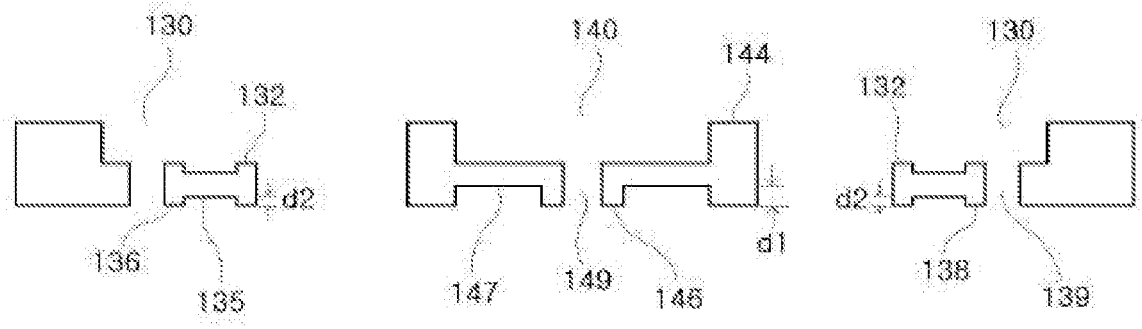
[FIG. 2A]
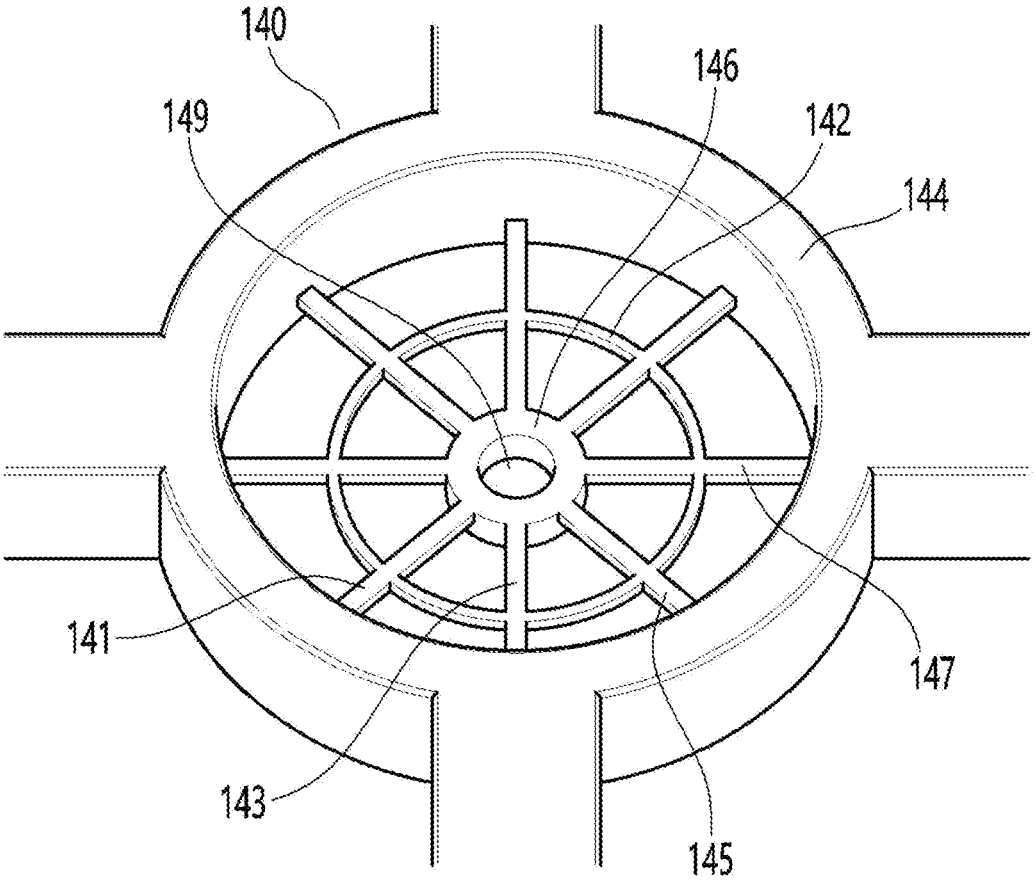

[FIG. 2B]
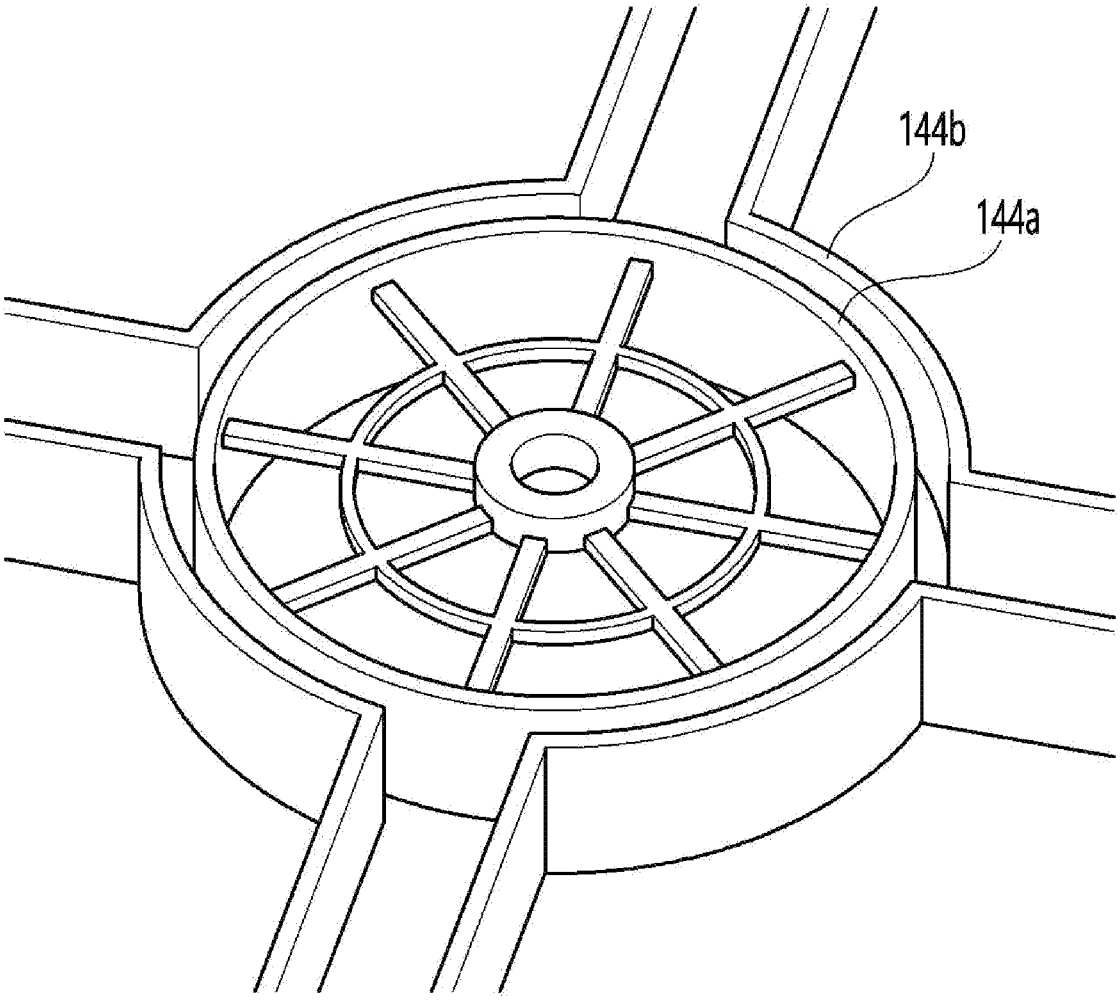

[FIG. 3A]
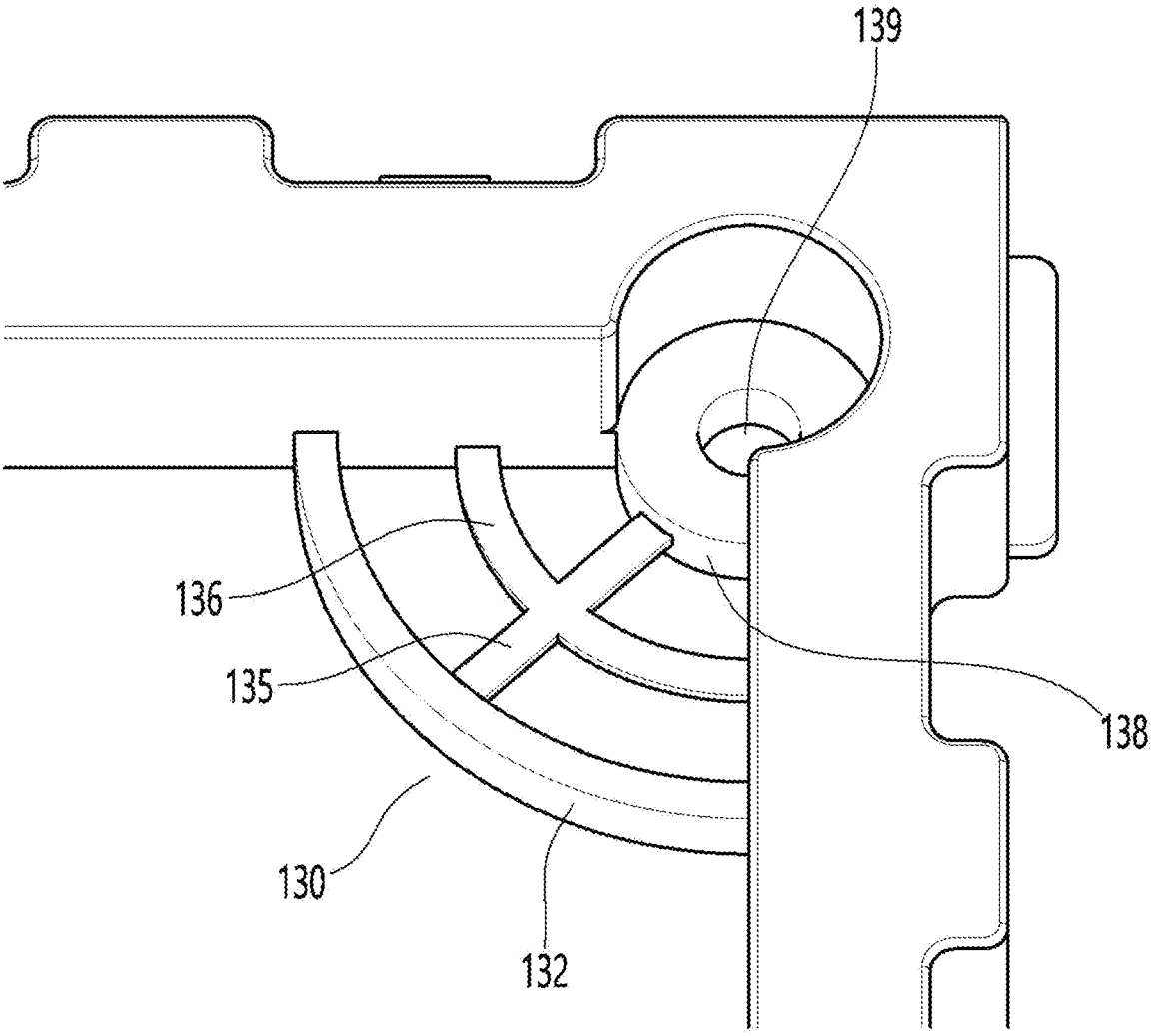

[FIG. 3B]
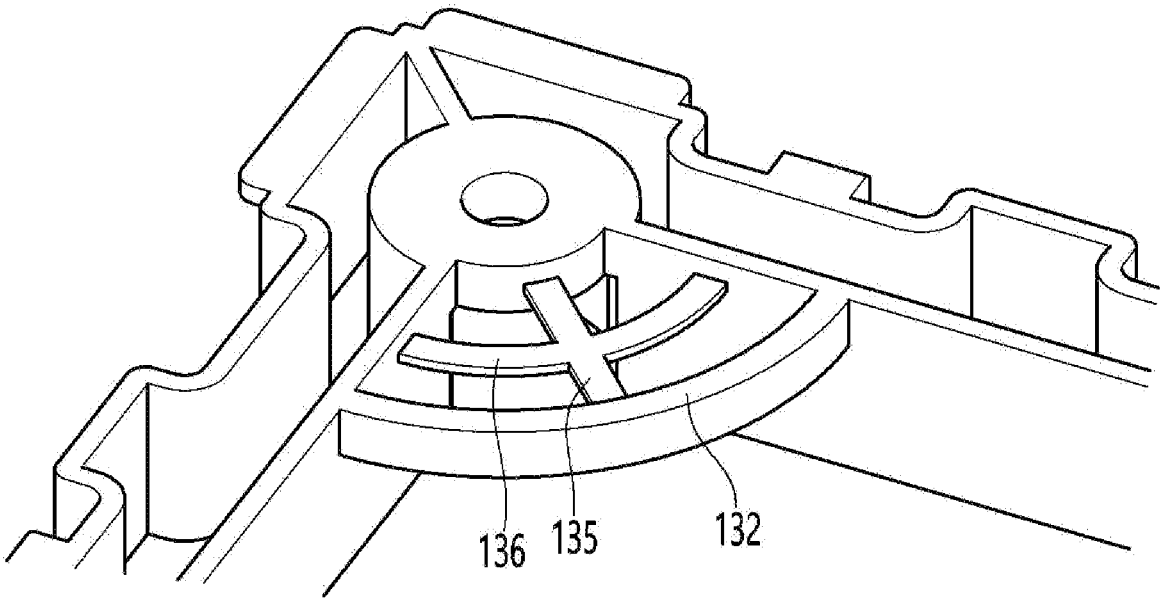

[FIG. 4A]
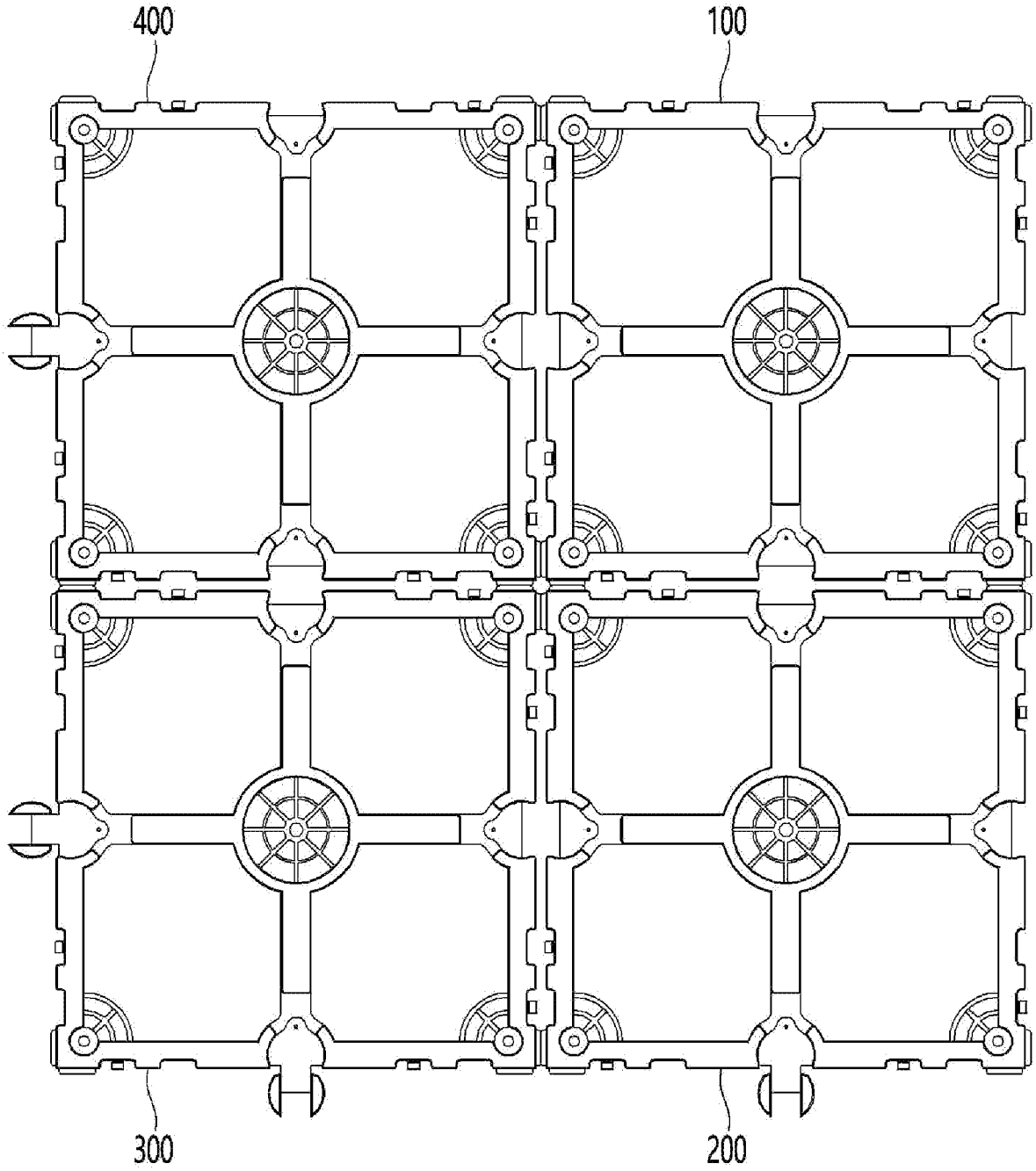

[FIG. 4B]
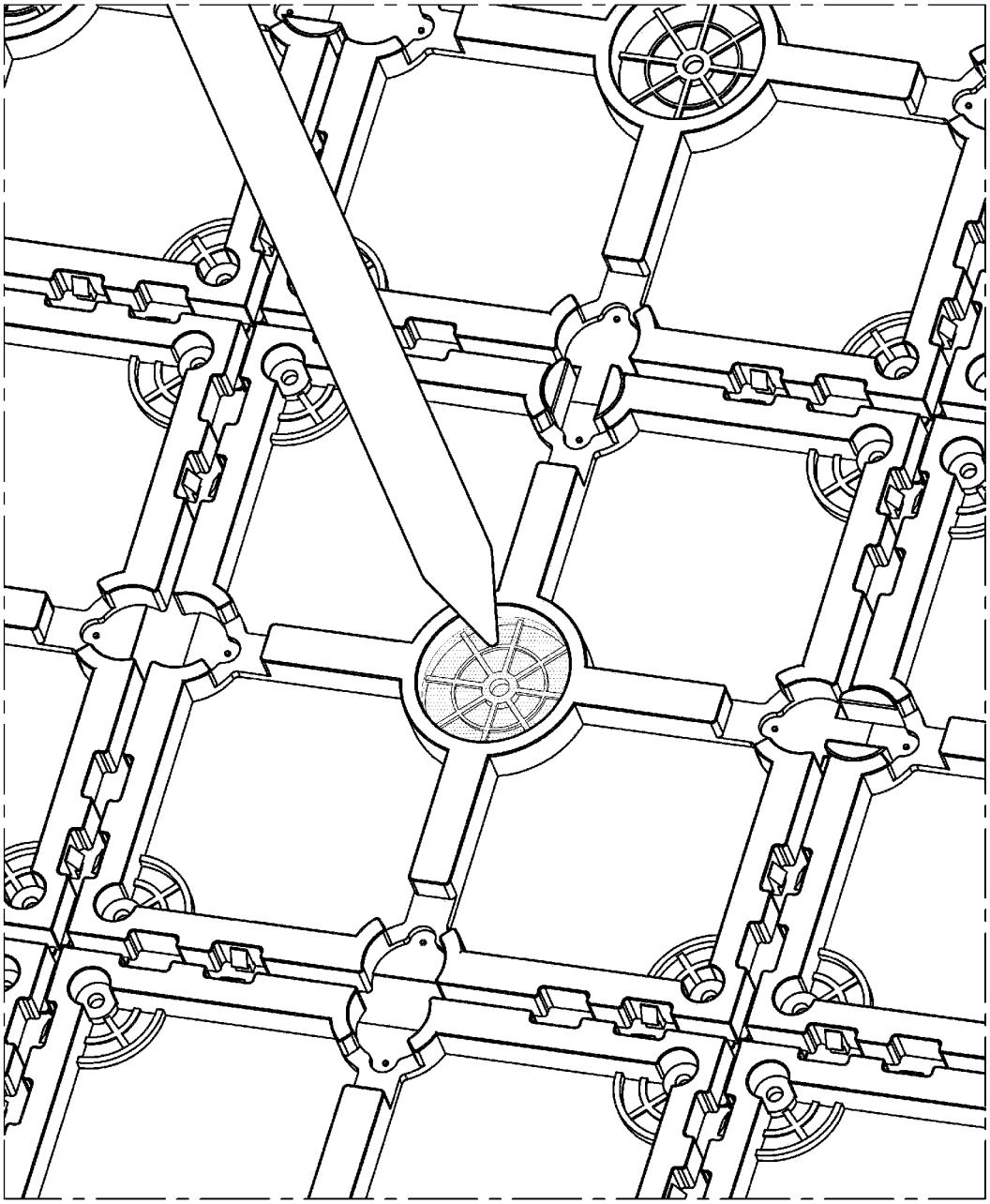

[FIG. 4C]
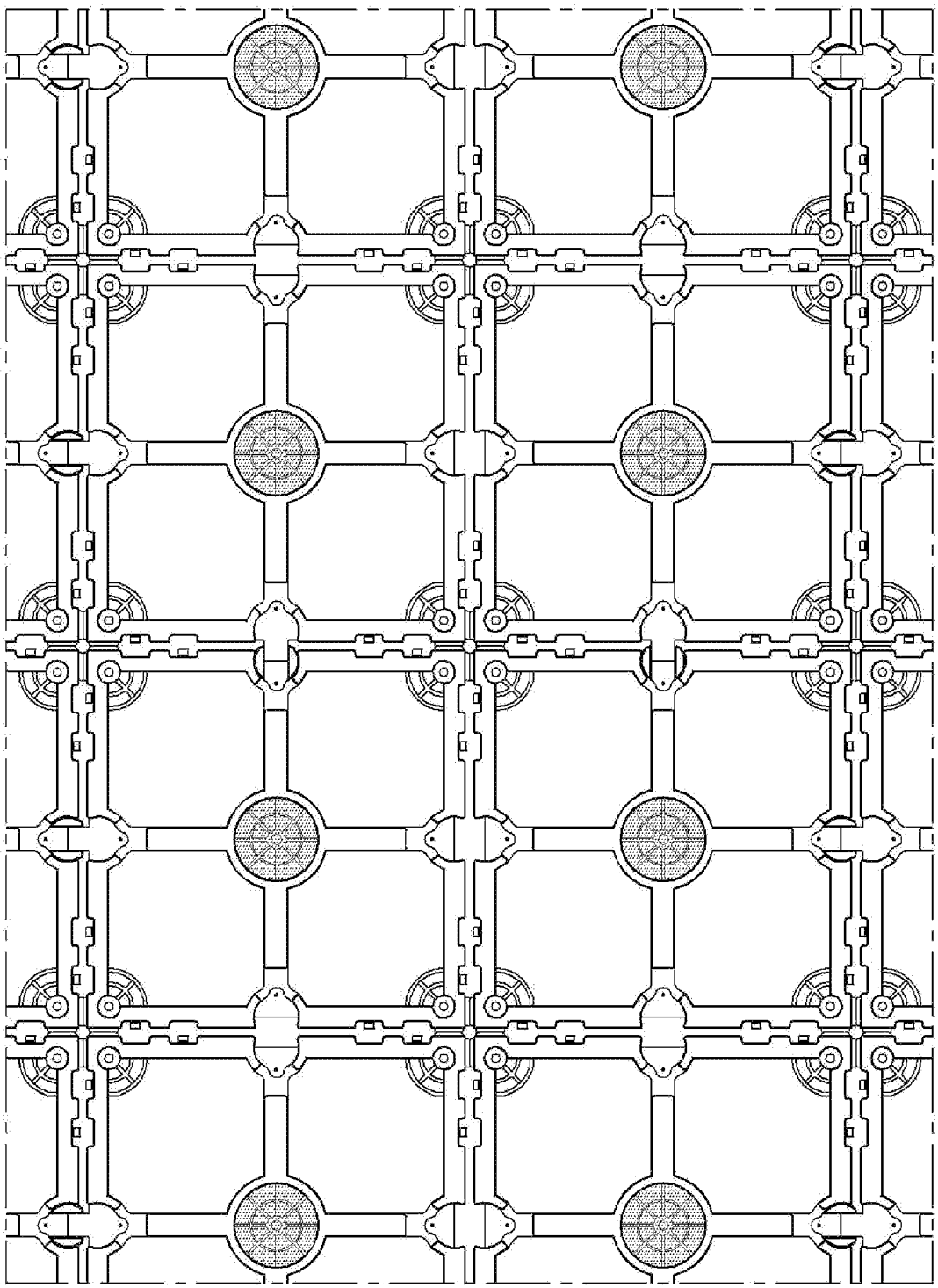

[FIG. 5A]
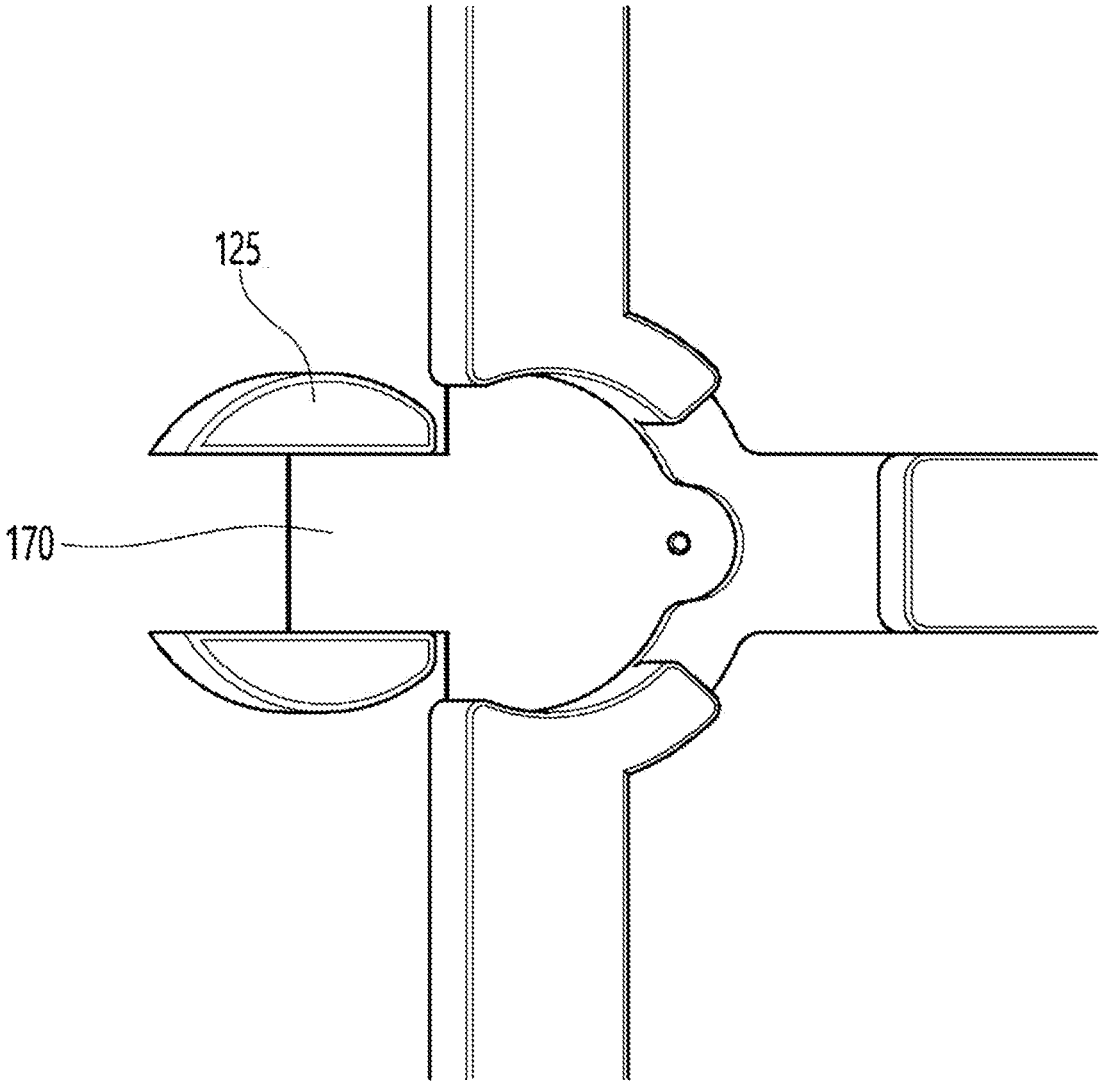

[FIG. 5B]
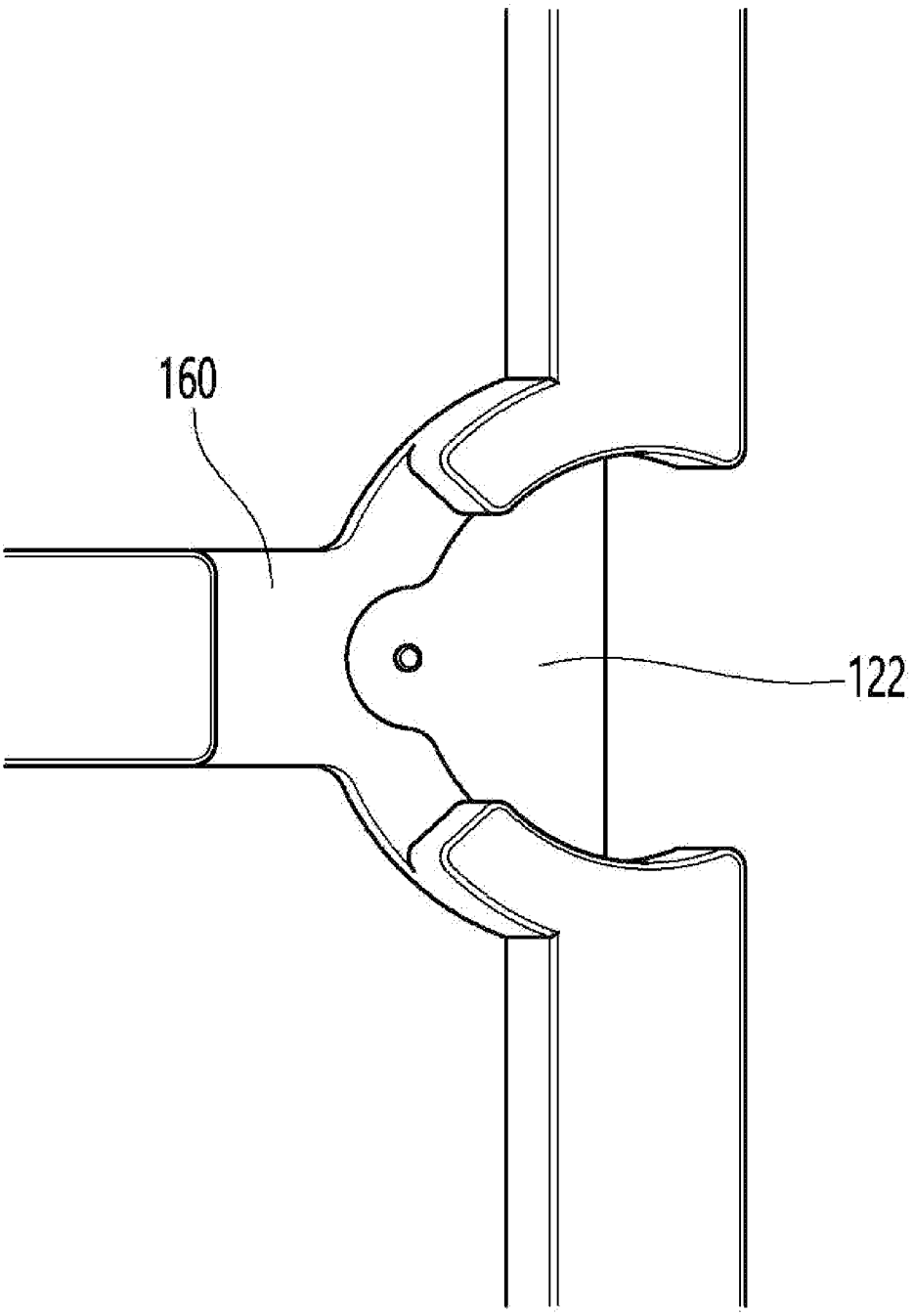

[FIG. 5C]
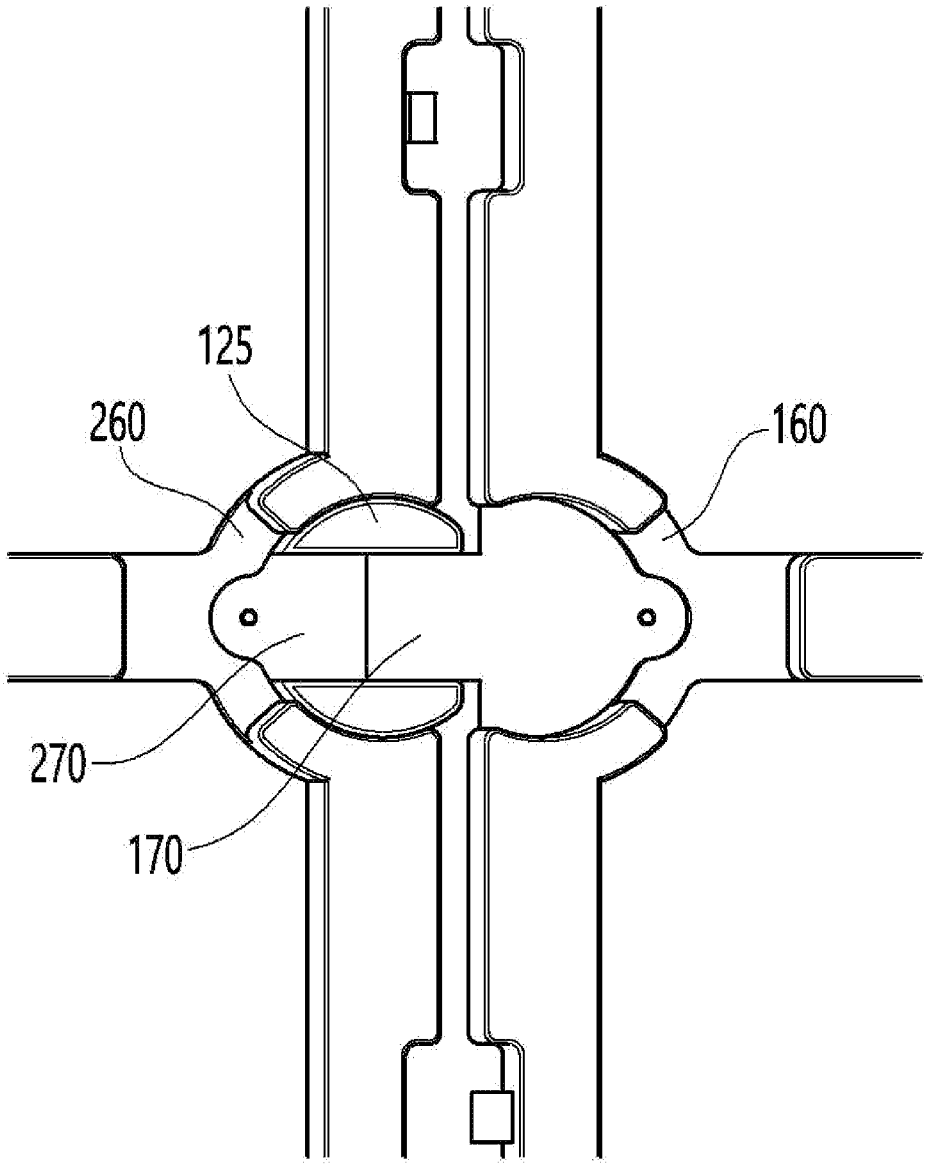

[FIG. 5D]
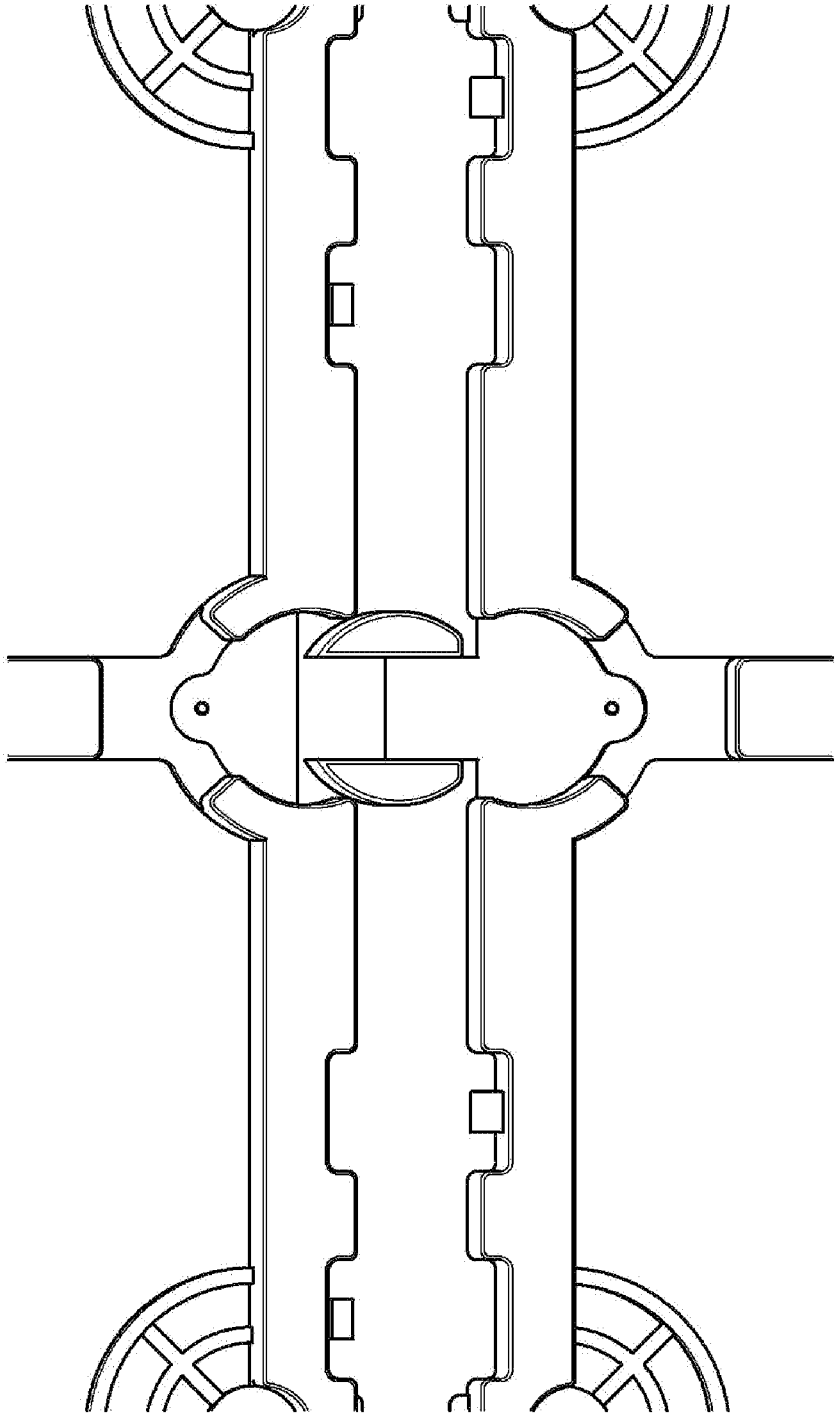

[FIG. 6A]
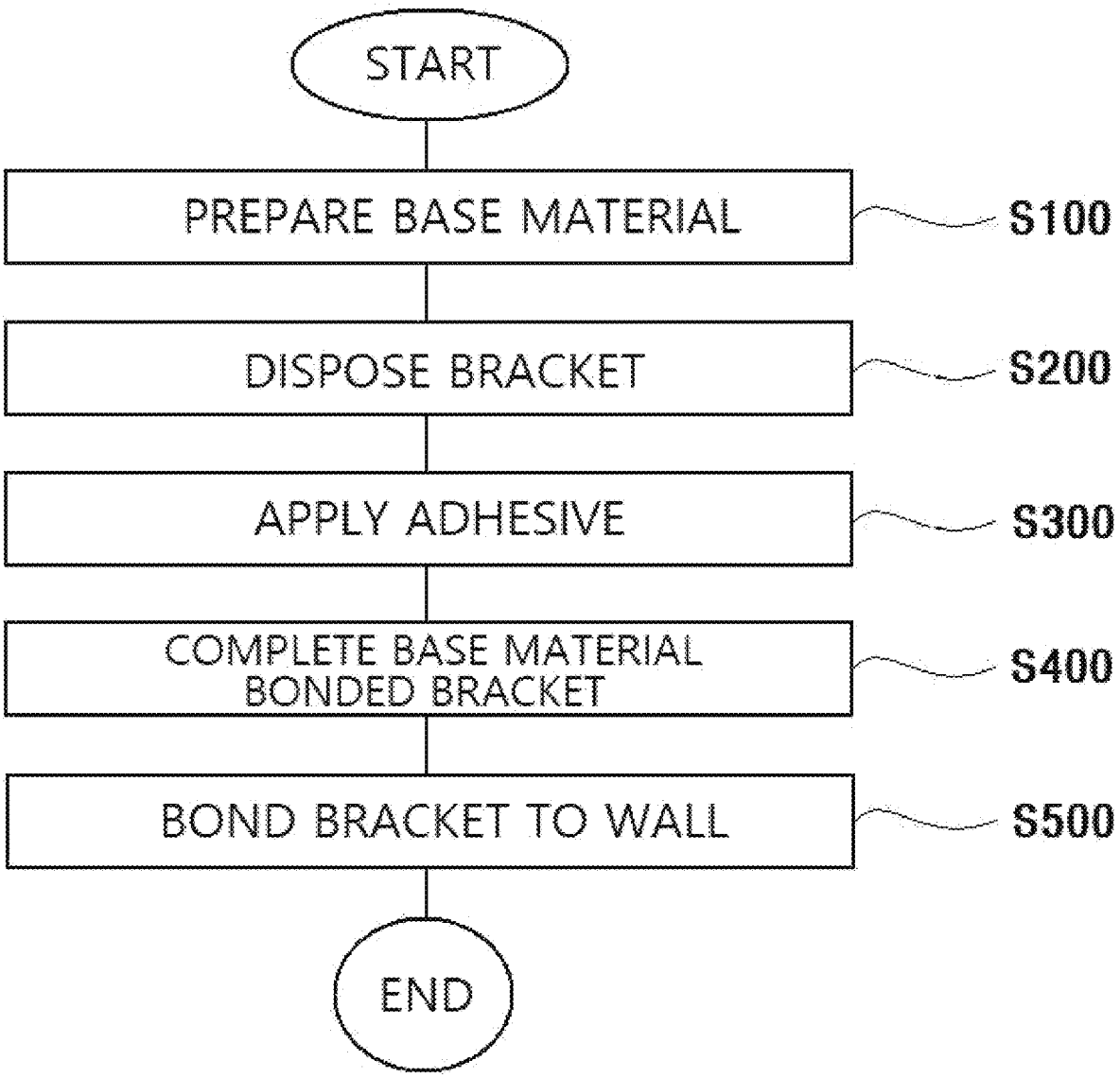

[FIG. 6B]
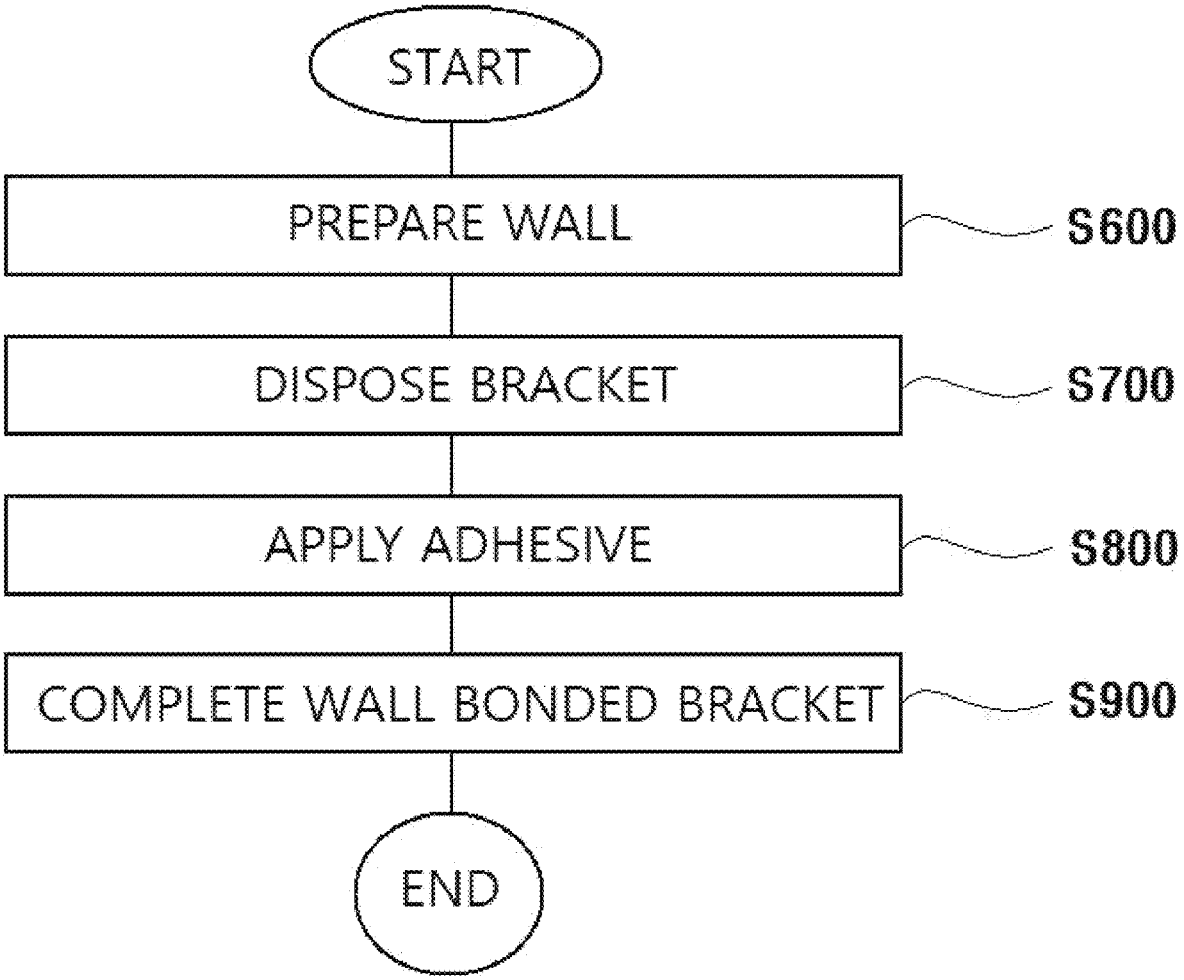

[FIG. 7A]
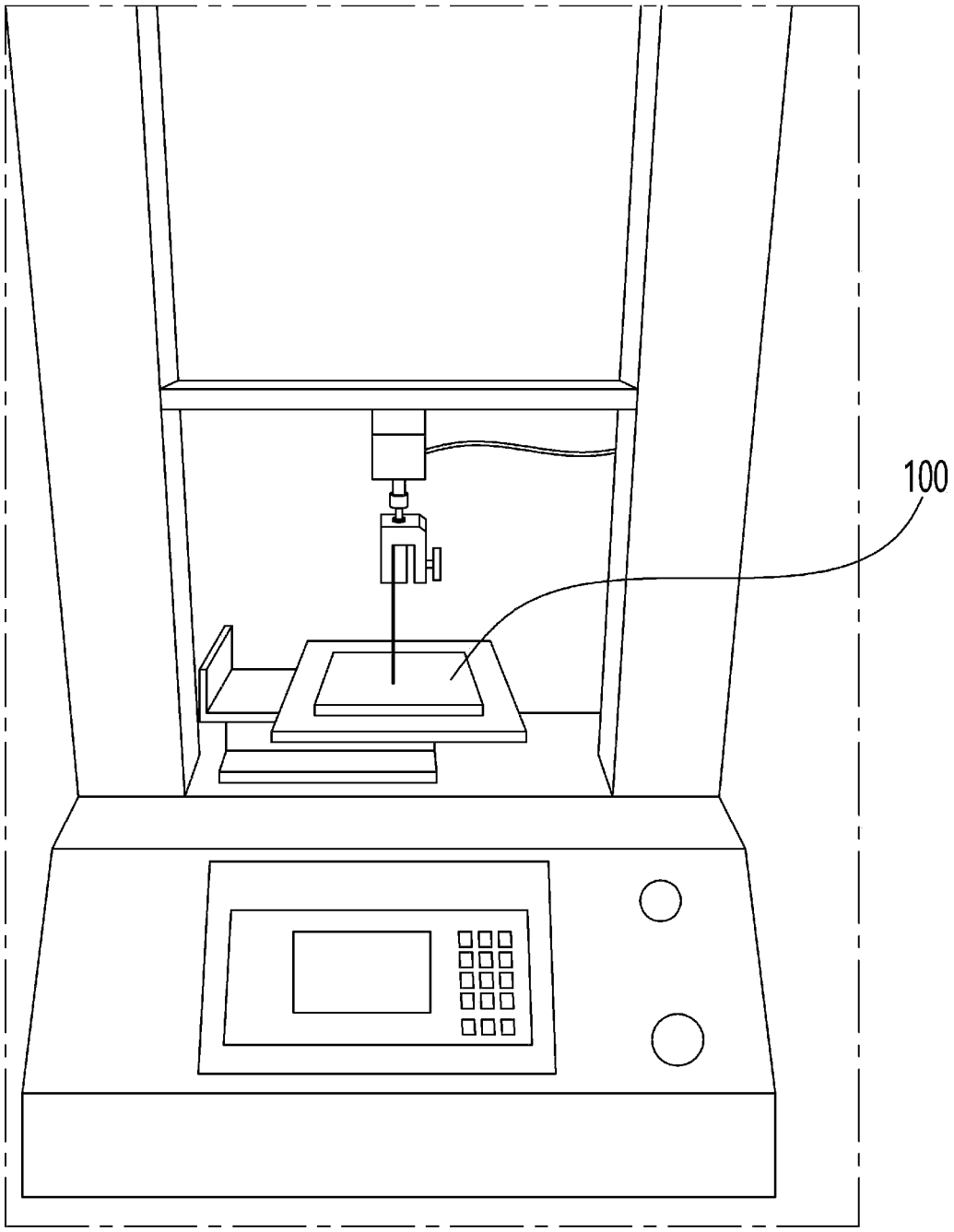

[FIG. 7B]
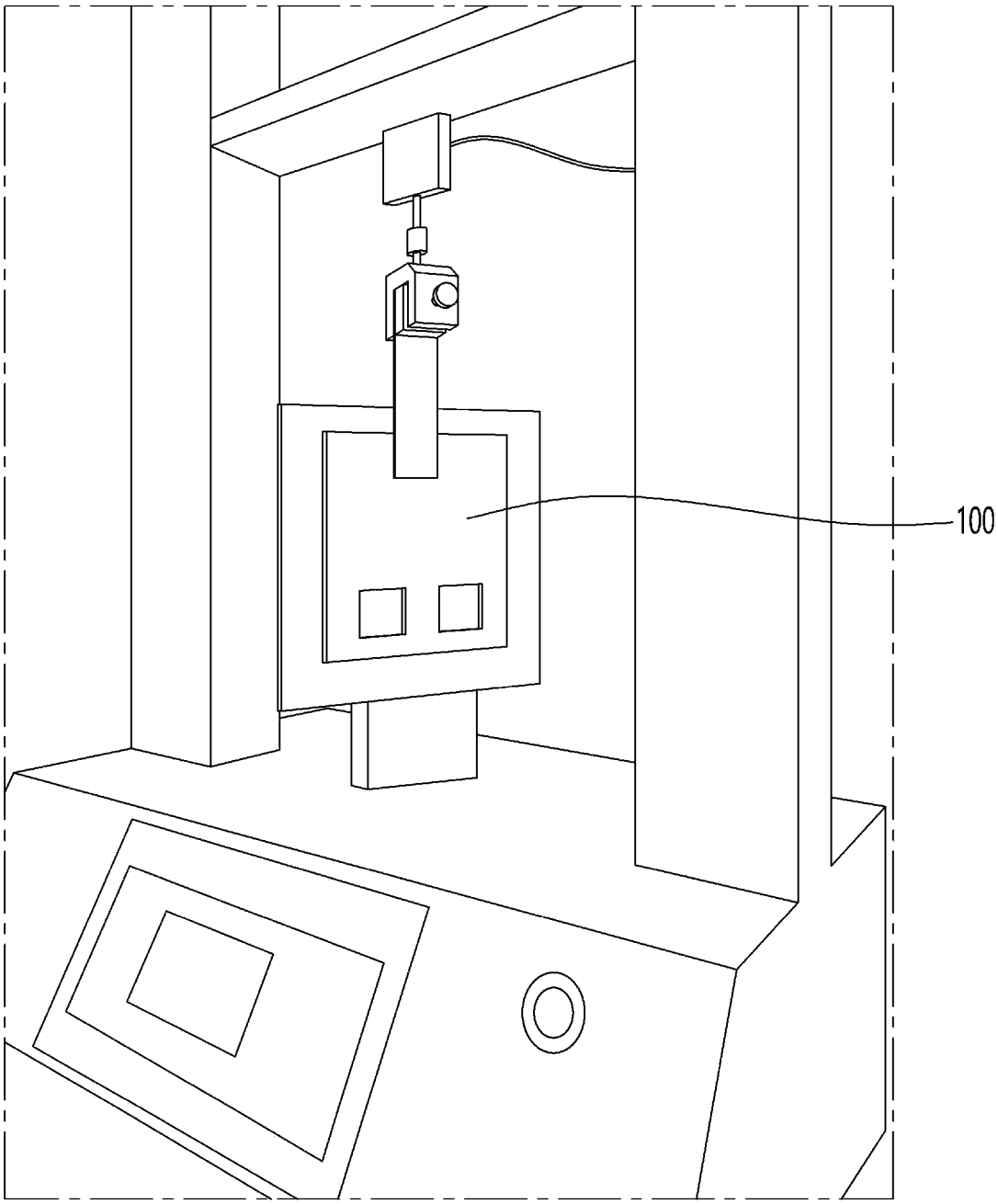

[FIG. 8]
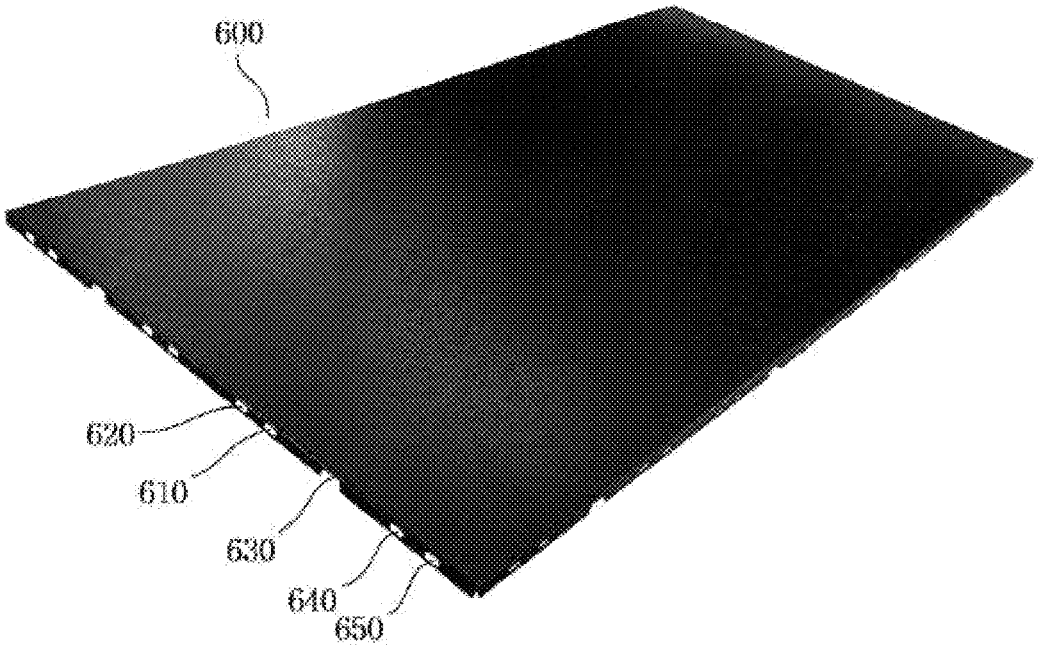

[FIG. 9A]
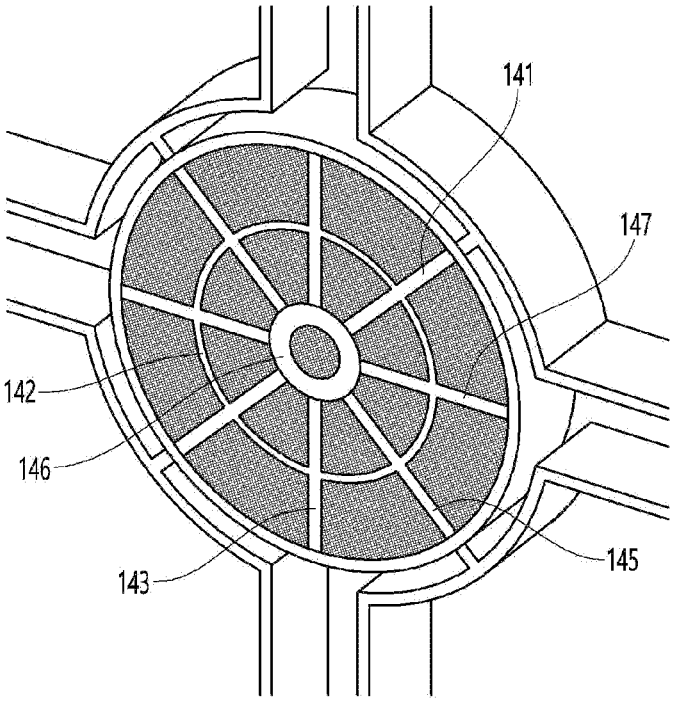
[FIG. 9B]
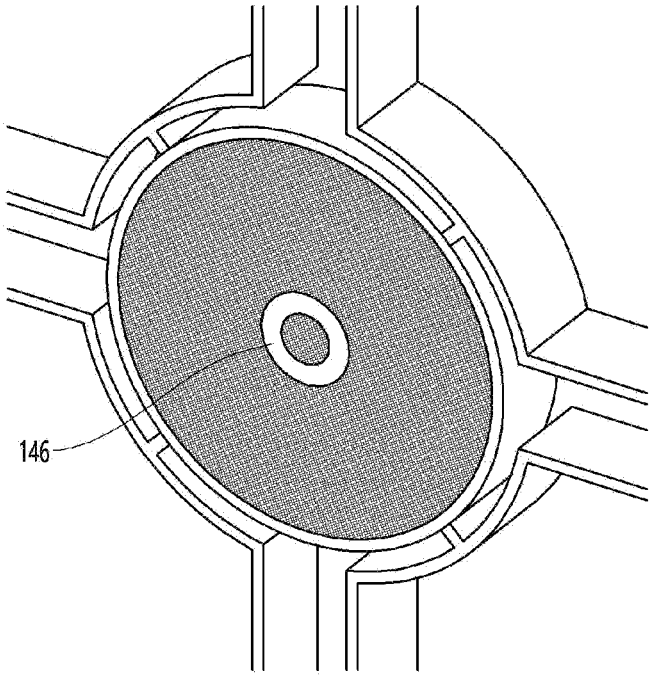

[FIG. 10]
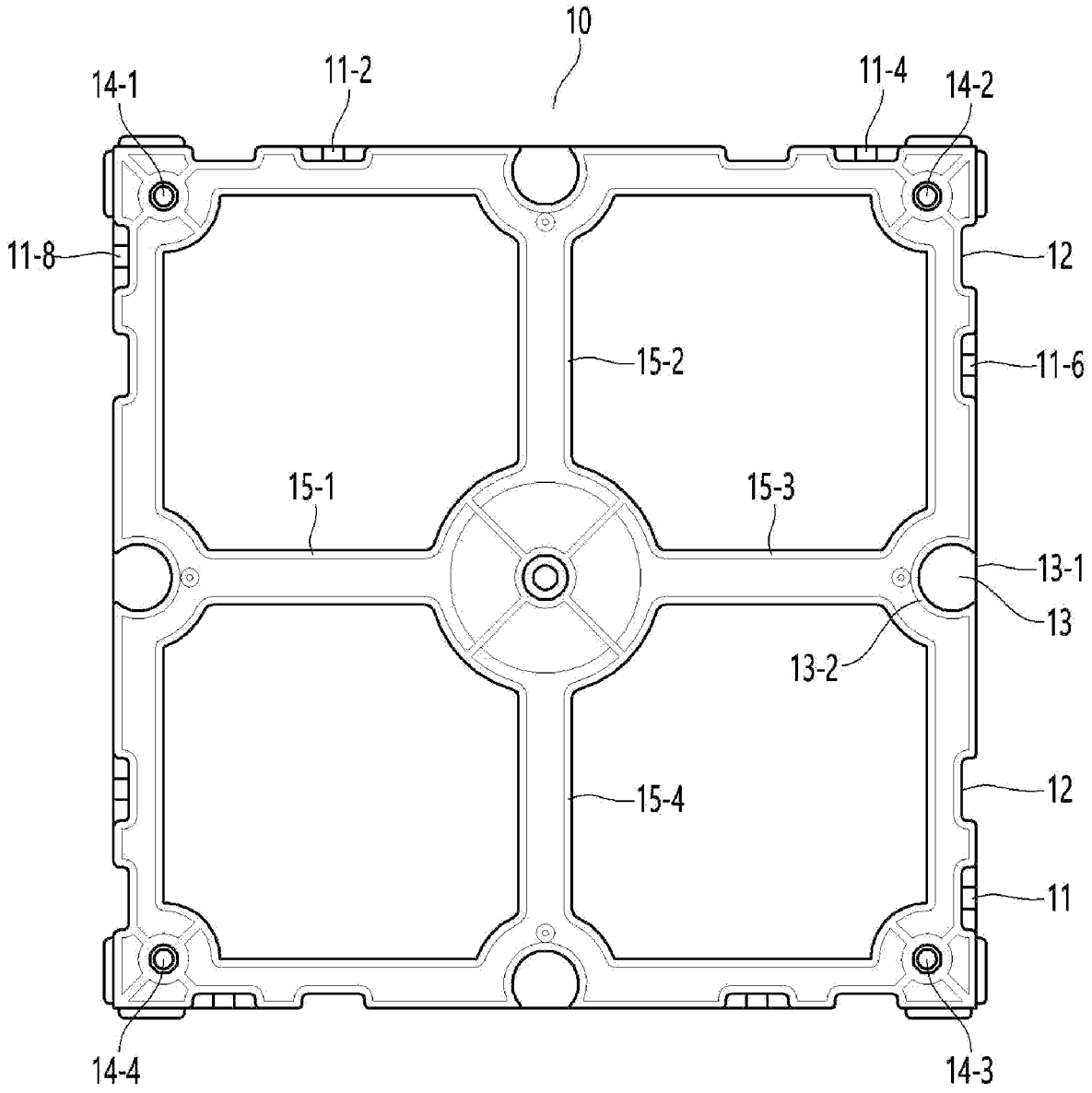

UNIT BRACKET, BRACKET AND BRACKET CONSTRUCTION METHOD FOR ATTACHING TO BASE MATERIAL AND WALL USING THE SAME

CROSS-REFERENCE TO RELATED APPLICATION(S)

This patent application claims priority to Korean Application No. 10-2020-0180693, filed Dec. 22, 2020, and the entire contents of which are incorporated herein by reference.

TECHNICAL FIELD

The present disclosure relates to a method for constructing a bracket to a wall and a bracket.

BACKGROUND ART

The related art of the present disclosure is as follows.

As the related art, Korean Patent No. 10-2074769 (Feb. 7, 2020) is registered as the disclosure registered by the applicant.

The related art is illustrated in FIG. 10 and binds a unit bracket with a bolt.

A unit interior material attachment structure 10 having wall bonding part bolt grooves 14-1, 14-2, 14-3, 14-4 is formed with binding projections 11 on the outermost portion of the unit interior material attachment structure 10 for attaching a metal interior material.

Connection part grooves 13 formed adjacent to the binding projection 11 are provided to connect a plurality of the interior material attachment structures to each other.

The interior material attachment structure 10 is formed with the binding projections 11 on the left and right of the connection part groove 13.

Here, the connection part grooves 13 are formed to be connected to each other in a rib form on rear surface portions 13-2 of the connection part grooves to firmly form the connection part groove 13.

A constant force is required to bind the adjacent interior material attachment structures bound to the left and the right of the connection part groove 13 when a connection mechanism 30 is connected through the connection part groove 13, and ribs 15-1, 15-2, 15-3, 15-4 are formed to serve to firmly maintain the interior material attachment structure, which is a plastic injection-molded product.

However, there is the difficulty in that the work should be conducted by a skilled person because it is necessary to require a lot of time and precise work to attach the unit interior material attachment structure to a wall and a base material with a bolt.

To solve the above problem, the present disclosure focuses on attaching a unit bracket to the base material or the wall accurately and quickly.

RELATED ART (Patent Document 1) Korean Patent No 10-1733212 (May 8, 2017)

(Patent Document 2) Korean Patent No 10-1947754 (Feb. 13, 2019)

(Patent Document 3) Korean Patent No 10-2152880 (Sep. 7, 2020)

(Patent Document 4) Korean Patent No 10-2103540 (Apr. 23, 2020)

(Patent Document 5) Korean Patent No 10-2074769 (Feb. 7, 2020)

Technical Problem

A first object of the present disclosure is to allow an unskilled person other than a skilled person to conduct the work skillfully and accurately by implementing ease of construction and accuracy of a base material bonded position of a bracket.

A second object of the present disclosure is to significantly reduce construction costs due to the speed of work.

Technical Solution

For achieving the objects, the present disclosure has the following configurations.

The present disclosure relates to a unit bracket in a square shape, in which outer surfaces of four surfaces of the unit bracket are formed with locking projections configured to insert a metal or plastic panel, and a center portion of the unit bracket is formed with a mesh part to be formed such that the bonding is possible at a vertical tensile strength and a horizontal tensile strength having desired forces even if the unit bracket and a wall or a base material are bonded with an adhesive, in order to bond the unit bracket to the wall or the base material.

Here, it is preferable that the outer surfaces of four surfaces of the unit bracket have coupling projection parts formed to couple adjacent other unit brackets from top to bottom formed on adjacent two surfaces, and have coupling groove parts formed in the other adjacent two surfaces.

Here, it is preferable that the coupling projection part has a coupling projection concave part formed on a center portion thereof, an outer surface of the coupling projection part has a semicircular shape, a coupling groove part of an adjacent unit bracket coupled to the coupling projection part also has a semicircular shape for coupling the coupling projection part, and a coupling groove is formed such that wires pass therethrough.

Here, it is preferable that the mesh part is additionally formed on the square corners of the unit bracket as well, and formed to maximize a bonding force when bonded to the wall or the base material with the adhesive.

Here, it is preferable that the wall or the base material and a rib are formed to be spaced apart from each other when the unit bracket is bonded to the wall or the base material such that the adhesive is sufficiently inserted into a portion of forming the rib of the mesh part as well to be formed such that the adhesive is also inserted into a lower surface of the rib to be bonded to the wall or the base material and the wall or the base material and the mesh part are integrated, thereby strengthening a bonding force.

A second exemplary embodiment is as follows.

The present disclosure relates to a bracket, in which in a set bracket having four unit brackets in a square shape as one unit, outer surfaces of four surfaces of the bracket are formed with locking projections configured to insert a metal or plastic panel, and a center portion of each unit bracket is formed with a mesh part to be formed such that the bonding is possible at a vertical tensile strength and a horizontal tensile strength having desired forces, even if the mesh part of the unit bracket is bonded to a wall or a base material with an adhesive.

Here, it is preferable that the outer surfaces of four surfaces of the bracket have coupling projection parts formed to couple adjacent brackets from top to bottom formed on adjacent two surfaces, and have coupling groove parts formed in the other adjacent two surfaces.

Here, it is preferable that the coupling projection part has a coupling projection concave part formed on a center portion thereof, an outer surface of the coupling projection part has a semicircular shape, a coupling groove part of an adjacent unit bracket coupled to the coupling projection part also has a semicircular shape for coupling the coupling projection part, and a coupling groove is formed such that wires pass therethrough.

Here, it is preferable that the outer surfaces of four surfaces of the bracket have coupling projection parts formed to couple adjacent other brackets from top to bottom formed on adjacent two surfaces, and have coupling groove parts formed in the other adjacent two surfaces.

Here, it is preferable that the mesh part is additionally formed on the square corners of the bracket as well, and formed to maximize a bonding force when bonded to the wall or the base material with the adhesive.

Here, it is preferable that the wall or the base material and a rib are formed to be spaced apart from each other when the bracket is bonded to the wall or the base material such that the adhesive is sufficiently inserted into a portion of forming the rib of the mesh part as well to be formed such that the adhesive is also inserted into a lower surface of the rib to be bonded to the wall or the base material and the wall or the base material and the mesh part are integrated, thereby strengthening a bonding force.

A third exemplary embodiment is as follows.

The present disclosure provides a method for constructing a base material bonded bracket including preparing a base material on which the bracket is to be bonded;

disposing a bracket which aligns and disposes a plurality of unit brackets on the base material;

applying an adhesive on a mesh part formed in the unit bracket, after the disposing of the bracket;

completing a base material bonded bracket having the plurality of unit brackets disposed therein after the adhesive is cured, after the applying of the adhesive; and bonding the base material bonded bracket to a wall to be constructed, after the completing of the base material bonded bracket.

Here, it is preferable that the mesh part is formed on a center portion of the unit bracket, and formed to maximize a bonding force when bonded to the base material with the adhesive.

Here, it is preferable that the mesh part is additionally formed on square corners of the unit bracket, and formed to maximize the bonding force when bonded to the base material with the adhesive.

Here, it is preferable that the base material and a rib are formed to be spaced apart from each other when the unit bracket is bonded to the base material such that the adhesive is sufficiently inserted into a portion of forming the rib of the mesh part as well to be formed such that the adhesive is also inserted into a lower surface of the rib to be bonded to the base material and the base material and the mesh part are integrated, thereby strengthening a bonding force.

Here, it is preferable that a set bracket having four unit brackets as one unit is formed.

A fourth exemplary embodiment is as follows.

The present disclosure provides a method for constructing a wall bonded bracket includes preparing a wall on which a bracket is to be bonded;

disposing a bracket which aligns and disposes a plurality of unit brackets on a wall;

applying an adhesive on a mesh part formed in the unit bracket, after the disposing of the bracket; and completing a wall bonded bracket having the bracket disposed on the wall after the adhesive is cured, after the applying of the adhesive.

Here, it is preferable that the mesh part is formed on a center portion of the unit bracket, and formed to maximize a bonding force when bonded to the wall with the adhesive.

Here, it is preferable that the mesh parts are formed on a center portion and square corners of the unit bracket, and formed to maximize a bonding force when bonded to the wall with the adhesive.

Here, it is preferable that the wall and a rib are formed to be spaced apart from each other when the unit bracket is bonded to the wall such that the adhesive is sufficiently inserted into a portion of forming the rib of the mesh part as well to be formed such that the adhesive is also inserted into a lower surface of the rib to be bonded to the wall and the wall and the mesh part are integrated, thereby strengthening a bonding force.

Here, it is preferable that four unit brackets are formed as a set bracket.

Advantageous Effects

As the first effect, it is possible to implement the ease of construction and the accuracy of the base material bonded position of the bracket, thereby allowing the unskilled person other than the skilled person to conduct the work skillfully and accurately.

As the second effect, it is possible to significantly reduce the construction costs due to the speed of work.

DESCRIPTION OF DRAWINGS

FIG. 1A illustrates a unit bracket according to the present disclosure.

FIG. 1B is a cross-sectional diagram taken along line c-c in FIG. 1A. (?)

FIG. 2A is a diagram illustrating a mesh part which is a center portion of the unit bracket.

FIG. 2B is a diagram illustrating an opposite part of FIG. 2A.

FIG. 3A is a diagram illustrating a mesh part of a corner portion of the unit bracket.

FIG. 3B is a diagram illustrating an opposite part of FIG. 3A.

FIG. 4A is a diagram illustrating forming four unit brackets according to the present disclosure as a set bracket.

FIG. 4B is a diagram illustrating a state of placing the bracket of FIG. 4A on a base material and injecting an adhesive into the mesh part.

FIG. 4C is a diagram illustrating a mesh part of a corner portion of the unit bracket.

FIG. 5A is a diagram illustrating a coupling projection part and a coupling projection concave part.

FIG. 5B is a diagram illustrating a coupling a groove part

FIG. 5C is a diagram illustrating combination of FIG. 5A and FIG. 5B.

FIG. 5D is a diagram illustrating separation of FIG. 5C.

FIG. 6A is a flowchart illustrating a method for bonding the bracket to the base material.

FIG. 6B is a flowchart illustrating a method for bonding the bracket to a wall.

FIG. 7A is a diagram illustrating a vertical tensile test.

FIG. 7B is a diagram illustrating a horizontal tensile test.

FIG. 8 is a diagram illustrating an interior material bonded to an upper portion of the bracket.

FIG. 9A is a diagram illustrating an adhesive bonded surface between the base material and the bracket in a state where there are no separation distances between ribs.

FIG. 9B is a diagram illustrating an adhesive bonded surface between the base material and the bracket in a state where there are separation distances between the ribs.

FIG. 10 is a diagram illustrating the related art.

DETAILED DESCRIPTION

Until now, in a panel installation construction using a bracket, the construction costs have been excessive by constructing the bracket on a wall or a base material, such that there is an urgent need to implement ease of construction and to reduce construction costs.

The present disclosure implements a reduction in the construction costs and the ease of construction for bonding the bracket to the wall or the base material at once according to such a request.

As definition of terms,

A horizontal tensile test means pulling the unit bracket to be horizontal to a direction of the bonded base material in the state where the unit bracket is bonded to the base material.

A vertical tensile test means pulling the unit bracket to be vertical to the direction of the bonded base material in the state where the unit bracket is bonded to the base material.

The present disclosure improves a bonding method by improving a structure of the bracket.

The present disclosure uses epoxy as the adhesive and uses a lightweight board as the base material.

The lightweight board has excellent flatness, is easily purchased, and corresponds to the lowest price board.

Hereinafter, a cellulose fiber reinforced cement (CRC) board is referred to as the lightweight board.

A gypsum board has excellent functions in terms of incombustibility, flatness, and price but when the bolt is fastened, desired vertical and horizontal tensile forces are below a standard value but when an adhesive is used, the gypsum board has vertical and horizontal tensile forces comparable to those of the lightweight board.

A reference sample was based on the vertical and horizontal tensile forces based on fastening the bolt to the center point formed on the center of the unit bracket on the lightweight board.

The tests for the vertical and horizontal tensile forces were compared by bonding the reference sample and the unit bracket to the lightweight board with the adhesive.

The present disclosure compared the vertical and horizontal tensile forces when the bolt was fastened to the center point formed on the center of the unit bracket with the vertical and horizontal tensile forces when the adhesive was used in the center point formed in the center of the unit bracket.

As a comparison result, the present disclosure forms the unit bracket in the mesh form on the center point of the unit bracket so as to have the vertical and horizontal tensile forces based on the bolt fastening even using the adhesive instead of fastening the bolt.

The present disclosure forms the unit bracket in the mesh form with a configuration capable of fastening the bolt in preparation for a case where a stronger strength is required.

The bonding force test for the unit bracket was conducted and the horizontal and vertical tensile tests through a tensile testing machine were conducted.

The testing machine has the following configuration.

The tensile testing machine was set as a maximum value of 20 kgf.

The tensile method bonds the unit bracket to the board and then tensions the unit bracket in horizontal and vertical directions with respect to the base material.

As illustrated in FIG. 7B the horizontal tensile strength was measured by pulling the panel by inserting the panel into the upper portion of the unit bracket in the mesh shape.

Test Procedure

1. Horizontal bonding force test (a maximum value of 20 kgf in the tensile testing machine)
2. A fixing force was measured by conducting a vertical bonding force test
3. Data analysis A reference detachment strength of the metal panel was about 3 kgf A reference bonding strength of the bracket (in case of inserting the bolt into the base material) was 4.5 to 12 kgf, and first, the bracket is placed at the accurate position of the base material or the wall and then a bond binder is used. Working with the bracket placed at the accurate position is much better than fixing the unit bracket with the bolt in terms of workability.

Of course, it is also okay to bond the bond binder to the bracket to bond the bracket to the wall. This is because the adhesive has fluidity and therefore, fine adjustment to the accurate position is possible.

Due to the bonding work, an unskilled person may accurately conduct the work on the base material or the wall as well.

In case of conducting the work with the bolt, if the bolt is inserted into the base material or the wall, it may be excluded that the accurate position of the bracket may be moved depending on the inclination.

There is a problem in the bonding force at which the bracket is bonded to the base material or the wall, and if the rib in the mesh form is formed not to fully touch the floor but to be slightly spaced apart from the floor, the mesh formed in the bracket, the base material or the wall under the mesh, and the adhesive are integrated, thereby maximizing the bonding force.

Strength of the lightweight (CRC) board+the unit bracket+the bolt fastening: about 800 kgf*mm.

Strength of the lightweight (CRC) board+the unit bracket (center mesh shape)+the adhesive: about 869 kgf*mm Breaking strength of the unit bracket: about 1174 kgf*mm A fixing method having a fixing force of the panel detachment strength or more fastens the bolt to one hole in the center portion of the unit bracket. And the unit bracket in comparison is also applied with adhesive to the mesh-shaped portion of the center portion of the unit bracket.

Among them, since the method for fixing the center mesh-shaped one point has a fixing force larger than that of the lightweight board+the bolt fastening, it is sufficient for substituting the existing CRC board+the bolt fastening.

Therefore, in case of the improvement using the lightweight board+the center mesh-shaped one point bonding method, the excellent flatness of the lightweight board is implemented and the ease of construction thereof is improved, thereby largely helping to reduce the construction costs.

To achieve the objects, the present disclosure has the following configurations.

A unit bracket 100 in a square shape has locking projections 110 configured to insert a metal or plastic panel formed on outer surfaces of four surfaces of the unit bracket 100.

The present disclosure relates to the bracket 100 in which a center portion of each unit bracket 100 is formed with a mesh part 140 to be formed such that the bonding is possible at a vertical tensile strength and a horizontal tensile strength having desired forces even if the mesh part of the unit bracket with the adhesive is bonded to a wall or a base material.

As the experiment result, rather, the strength in the above case appears larger than the strength in case of coupling the bolt to the center portion of the unit bracket 100 together with the base material.

Outer surfaces of four surfaces of the unit bracket 100 have coupling projection parts 125 configured to couple other adjacent unit brackets 200, 300, 400 from top to bottom formed on adjacent two surfaces, and have coupling groove parts 122 formed on the other adjacent two surfaces, thereby conducting the work with a plurality of brackets.

The semicircular coupling projection part 125 of the unit bracket 100 and the coupling groove parts 122 of the adjacent unit brackets 200, 300, 400 composed of a semicircular concave part are inserted from top to bottom like building Lego, and therefore, as long as the projection part and the concave part of the coupling portion are not damaged, the coupling with the adjacent unit brackets is not released even when a traction force from left to right or from top to bottom is generated.

In other words, each of coupling projection concave parts 170, 270 is formed between the coupling projection parts 125.

A wire or an audio wire is disposed inside the bracket by forming the center portion as a space portion. It is preferable that an outer surface of the coupling projection part 125 is formed in a semicircular shape and the coupling groove part 122 of the adjacent unit bracket 100 coupled to the coupling projection part 125 is also formed in a semicircular shape for coupling the coupling projection part 125, and the coupling groove part 122 is formed such that wires pass therethrough.

Here, it is preferable that the mesh parts 130 are additionally formed on square corners of the unit bracket 100 as well, and formed to maximize the bonding force when bonded to the wall or the base material with the adhesive.

If a decoration cabinet is separately bonded in case of bonding the bracket to the wall and bonding the panel to the upper portion of the bracket, it is preferable to additionally form the mesh parts on the square corners of the unit bracket as well to bond these portions with the adhesive.

Here, it is preferable that the wall or the base material and ribs 135, 136, 141, 142, 143, 145, 146, 147 of the mesh parts 130, 140 are formed to be spaced apart from each other by a separation distance (d) when the unit bracket 100 is bonded to the wall or the base material 500 such that the adhesive is sufficiently inserted into the portions of forming the ribs 135, 136, 141, 142, 143, 145, 146, 147 of the mesh parts 130, 140 as well to be formed such that the adhesive is also inserted into lower surfaces of the ribs to be bonded to the wall or the base material and the wall or the base material and the mesh parts 130, 140 are integrated, thereby strengthening the bonding force.

A second exemplary embodiment is as follows.

A set bracket 100, 200, 300, 400 forming four unit brackets 100 in the square shape as one unit is formed. The present disclosure is composed of the set bracket 100, 200, 300, 400 made of plastic to form four unit brackets as one upon injection-molding.

Outer surfaces of four surfaces of the bracket are formed with the locking projections 110 configured to insert the metal or plastic panel. Four surfaces of the metal or plastic panel are bent at right angles and holes are formed in portions corresponding to the locking projections 110 to be forcibly fitted and inserted therein.

The present disclosure relates to the bracket in which the center portion of each unit bracket is formed with the mesh part 140 to be formed such that the bonding is possible at the vertical tensile strength and the horizontal tensile strength having desired forces even if the bracket is bonded to the wall or the base material with the adhesive in order to bond the bracket to the wall or the base material.

Here, it is preferable that the outer surfaces of four surfaces of the brackets 100, 200, 300, 400 have the coupling projection parts 125 configured to couple other adjacent unit brackets from top to bottom formed on adjacent two surfaces, and have the coupling groove parts 122 formed in the other adjacent two surfaces.

The semicircular coupling projection part 125 of the unit bracket 100 and the coupling groove parts 122 of the adjacent unit brackets 200, 300, 400 composed of the semicircular concave part are inserted from top to bottom like building Lego and therefore, the coupling is not released even if a traction force from left to right or from top to bottom is generated.

In other words, it is preferable that the coupling projection part 125 has the coupling projection concave parts 170, 270 formed on a center portion thereof, the outer surface of the coupling projection part 125 has a configuration in the semicircular shape, the coupling groove part 122 of the adjacent unit bracket 100 coupled to the coupling projection part 125 is also formed in the semicircular shape for coupling the coupling projection part 125, and the wires and the audio wire are moved into the bracket to force the wires to be hidden in the wall by forming the coupling groove part 122 such that the wires pass therethrough, thereby having no protrusion of any wire on the wall for aesthetics.

Further, it is preferable that the outer surfaces of four surfaces of the bracket have the coupling projection parts 125 configured to couple other adjacent unit brackets from top to bottom formed on adjacent two surfaces, and have the coupling groove parts 122 formed in the other adjacent two surfaces.

Here, it is preferable that the mesh parts 130, 140 are additionally formed on the square corners of the bracket as well and formed to maximize the bonding force when bonded to the wall or the base material with the adhesive.

Further, the ribs of the mesh part formed on the center portion of the bracket are formed at a separation distance (d1) from the bottom such that the wall or the base material and ribs 135, 136, 141, 142, 143, 145, 146, 147 are spaced apart from each other when the bracket is bonded to the wall or the base material such that the adhesive is sufficiently inserted into the portions of forming the ribs 135, 136, 141, 142, 143, 145, 146, 147 of the mesh part 140 as well. The ribs of the mesh part form a separation distance (d2) even on the square corners of the bracket.

It is most preferable that the separation distances (d1, d2) corresponding to separation gaps are 2 to 5 mm.

This is because the separation distances according to the viscosity of the adhesive and the injection pressure of the adhesive when the adhesive is injected are limited.

When formed like the above, it is preferably configured such that the adhesive is also inserted into the lower surface of the rib to bond the bracket to the wall or the base material and to integrate the wall or the base material and the mesh part 140, thereby strengthening the bonding force.

It is preferable that the separation distance of d1 is larger than the separation distance of d2.

It is preferable that the separation distances of d1, d2 are formed at 2 to 4 mm.

The separation gaps according to the viscosity of the adhesive and the injection pressure of the adhesive when the adhesive is injected are limited.

It is possible to obtain the bonding force between the base material and the lower portion of the rib in a proper viscosity range of the adhesive by setting a separation step as a range of 2 to 4 mm.

As the adhesive, other adhesives commercially sold as well as epoxy are possible.

It may be confirmed that an effective contact area is increased by 40% or more if the separation distance (d1) in FIG. 9B exists, compared to the bonding area of the bracket, thereby obtaining an excellent bonding force, in case of bonding the bracket to the base material when the separation distance (d1) corresponding to the separation gap in FIG. 9A is set as 0.

In case of forming the rib for bonding the bracket to the base material with the adhesive, as an experiment example, the area of the rib is consumed by about 40% in the space portion where the bracket is bonded to the base material with the adhesive.

Therefore, it may be seen that when the rib is spaced apart from the base material by an interval of about 2 mm so as not to closely contact the base material, the bonding area is increased by about 40%, thereby increasing the bonding force.

As an exemplary embodiment accordingly, it may be seen that in FIG. 9A, the bonding area between the adhesive and the base material is 491.222 $mm^2$ (area other than the area of the reference rib considering the viscosity of the adhesive and the strength of the bracket), whereas in FIG. 9B, the bonding area between the adhesive and the base material is 692.365 $mm^2$ (it is the same as that of FIG. 9A, the rib of the bracket is formed such that the rib is spaced apart from the base material, and the area is the entire area in the space where the adhesive is bonded to the base material), such that the bonding area is increased by 40% or more, thereby further increasing the bonding force.

The center mesh (rib) bonding fixing force (869 kgf*mm) described in the bonding force test between the gypsum board and the bracket exceeds a fixing force (800 kgf*mm) in a method for fastening the bracket to the CRC board with a screw and therefore, it is possible to substitute the fixing method.

The CRC board is only for the screw (vis) fastening which improves the weakness of the gypsum board and is 2 to 3 times more expensive than the gypsum board.

However, the gypsum board has a lower attachment strength than a standard value due to the screw fastening and therefore, may not be used as the base material of the bracket according to the present disclosure with the screw fastening.

In other words, the gypsum board is only for the adhesive and has excellent unit price competitiveness according to the Fire Defense Regulation but is not suitable for the screw (vis) fastening due to the high hardness and brittleness of the material.

An MDF board is very efficient for the adhesive bonding and the screw (vis) fastening and there is no problem in terms of strength but the MDF board is difficult to use according to the Fire Defense Regulation due to the volatilization and flammability problem upon fire of a contained toxic adhesive.

The strength in case of fastening the bracket to the CRC board with the screw and the bonding strength in case of bonding the bracket to the gypsum board with the epoxy adhesive are described as follows.

A horizontal attachment force means a force of withstanding when the bracket is pulled in a state of being horizontal to a wall surface, and first, there is a case of coupling only the center portion of the bracket to the base material with the screw or the epoxy.

Since the center portion and square corners of the bracket are not fastened or bonded with the screw or the epoxy unless it is a special case, as the exemplary embodiment, a specific exemplary embodiment having experimented a case of fastening and coupling only the center portion of the bracket with the screw and with the epoxy will be first described.

If a special bonding strength is required, the adhesive may also be formed in a double layer, such as simultaneously mounting the epoxy and the screws on all four corners of the bracket.

It is shown that the horizontal attachment force is 8.32 kgf if the bracket in case of mounting the screw only on the center of the bracket is bonded to the CRC board, which is the base material, whereas the bonding force of the bracket in case of bonding only the center portion of the bracket to the gypsum board with the epoxy is 21.74 kgf and the bonding force in case of bonding the bracket to the gypsum board with the epoxy is far superior to the attachment force in case of attaching the bracket to the CRC board, which is the base material, with the screw.

It is shown that the bonding force of the bracket in case of bonding only the center portion of the bracket to the MDF with the epoxy is 25.91 kgf and the bonding force in case of bonding the bracket to the MDF with the epoxy is far superior to the attachment force 8.32 kf in case of attaching the bracket to the CRC board, which is the base material, with the screw.

Second, it may be seen that the horizontal attachment force in a case where the bracket in case of mounting the screws on both the center portion of the bracket and four corners of the bracket is attached to the CRC board, which is the base material, is 26.24 kgf, whereas the bonding force of the bracket in case of bonding both the center portion of the bracket and four corners of the bracket to the gypsum board with the epoxy is 24.03 kgf and the attachment force in case of attaching the bracket to the CRC board, which is the base material, with the epoxy and the bonding force in case of bonding the bracket to the gypsum board with the epoxy are similar to each other.

The attachment force satisfies the standard value sufficiently.

The bonding force of the bracket in case of bonding both the center portion of the bracket and four corners of the bracket to the MDF with the epoxy is 25.24 kgf, and the attachment force in case of attaching the bracket to the CRC board, which is the base material, with the epoxy is 26.24 kgf and shows the characteristics similar to the bonding force in case of bonding the bracket to the MDF with the epoxy.

Next, the vertical attachment force will be described as follows.

The vertical attachment force means a force of withstanding when the bracket is pulled in a state of being vertical to the wall surface.

First, it is the result of experimenting the exemplary embodiment in a case of fastening only the center portion of the bracket to the CRC base material, which is the reference.

The vertical attachment force in case of fastening the center portion of the bracket to the CRC base material with the screw corresponds to 2.92 kgf.

On the other hand, it may be seen that the bonding force in case of bonding the center portion of the bracket to the gypsum board with the epoxy is 3.99 kgf and the bonding force in case of bonding the bracket to the gypsum board with the epoxy is better by about 30%.

Further, it may be seen that the bonding force in case of bonding the center portion of the bracket to the MDF base material with the epoxy is 3.56 kgf and the attachment force is also better than 2.92 kgf, the vertical attachment force of the CRC base material by about 20%.

Second, it is the result of experimenting the vertical attachment force in case of simultaneously fastening the center portion and four corners of the bracket to the CRC base material.

The vertical attachment force in case of fastening the center portion and four corners of the bracket to the CRC base material with the screw corresponds to 6.16 kgf.

On the other hand, it may be seen that the bonding force in case of bonding the center portion and four corners of the bracket to the gypsum board with the epoxy is 8.59 kgf and the bonding force in case of bonding the bracket to the gypsum board with the epoxy is better by about 40%.

Further, it may be seen that the bonding force in case of bonding the center portion and four corners of the bracket to the MDF base material with the epoxy is 14.95 kgf and its bonding force is also better by about 140% than 6.16 kgf, the vertical bonding force of the CRC base material.

A third exemplary embodiment is as follows.

Preparing a base material (S100) is provided.

Next, disposing a bracket (S200) which aligns and disposes a plurality of unit brackets 100 on the base material is provided.

After the disposing of the bracket (S200), applying an adhesive (S300) to the mesh part 140 formed in the unit bracket 100 is provided. At this time, the unskilled person other than the expert may accurately dispose the unit bracket and conduct the work very quickly and easily.

After the applying of the adhesive (S300), completing a base material bonded bracket (S400) having the plurality of unit brackets 100 disposed therein after the adhesive is cured is provided.

After the completing of the base material bonded bracket (S400), a method for constructing the base material bonded bracket includes bonding the bracket to the wall to be constructed (S500).

Here, the mesh part 140 is formed on the center portion of the unit bracket 100 and formed to maximize the bonding force when bonded to the base material with the adhesive.

As described above, the strength at which the mesh part on the center portion of the unit bracket is bonded with the adhesive without inserting the bolt holes into the center portion of the unit bracket is larger than the strength at which the bolts are inserted into bolt holes 139, 149 in the center portion of the unit bracket, which is the reference.

Here, the corner mesh parts 130 are additionally formed on the square corners of the unit bracket 100 and may be formed to maximize the bonding force when bonded to the base material with the adhesive.

When a larger force is required by forming a separate bolt hole, the bolt may also be selectively inserted into the bolt hole.

Here, the base material and the ribs 135, 136, 141, 142, 143, 145, 146, 147 are formed to be spaced apart from each other when the unit bracket 100 is bonded to the base material such that the adhesive is sufficiently inserted into the portions of forming the ribs 135, 136, 141, 142, 143, 145, 146, 147 of the mesh parts 130, 140 as well to be formed such that the adhesive is also inserted into the lower surfaces of the ribs to bond the unit bracket to the base material and to integrate the base material with the mesh parts 130, 140, thereby strengthening the bonding force.

When the bracket is formed by forming four unit brackets 100 as one unit, the work speed is higher, such that it is preferable to form four brackets as the bracket of one unit by injection-molding the plastic.

A fourth exemplary embodiment is as follows.

Preparing a wall (S600) to be flat is provided.

Disposing a bracket (S700) which aligns and disposes a plurality of unit brackets 100 on the wall is provided.

Next, after the disposing of the bracket (S700), applying an adhesive (S800) to the mesh parts 130, 140 formed in the unit bracket 100 is provided.

After the applying of the adhesive (S800), a method for constructing a wall bonded bracket includes completing a wall bonded bracket (S900) having the bracket disposed on the wall after the adhesive is cured.

Here, the mesh part 140 is formed on the center part of the unit bracket 100, and formed to maximize the bonding force when bonded to the wall with the adhesive.

The mesh parts 130, 140 are formed on the center portion and four corners of the unit bracket 100 to have a larger bonding force when bonded to the wall with the adhesive.

Further, the wall and the ribs 135, 136, 141, 142, 143, 145, 146, 147 are formed to be spaced apart from each other when the unit bracket 100 is bonded to the wall such that the adhesive is sufficiently inserted into the portions of forming the ribs 135, 136, 141, 142, 143, 145, 146, 147 of the mesh parts 130, 140 as well to be formed such that the adhesive is also inserted into the lower surfaces of the ribs to bond the unit bracket to the wall and to integrate the wall and the mesh parts 130, 140, thereby strengthening the bonding force.

When the set bracket forming four unit brackets 100 as one unit is formed, the work may be done very quickly.

Locking projection holes 610, 620, 640, 650 of the metal panel bound to the locking projections 110 are provided. Connection part holes 630 are coupled to the coupling projection parts 125. In other words, the connection part hole 630 forms the space portion such that a metal interior material 600, which is the panel, is not locked to the coupling projection part 125.

It is preferable that the locking projection holes 610, 620, 640, 650 are formed by two on the left and right of the connection part hole 630.

The terms or words used in the present specification and claims should not be interpreted as being limited to their ordinary or dictionary meanings, and based on the principle that the inventor may properly define the concept of the term in order to explain his/her invention in the best way, should be interpreted as a meaning and concept consistent with the technical spirit of the present disclosure.

Therefore, since the exemplary embodiments and the configurations shown in the drawings described in the present specification are only the most preferred exemplary embodiment of the present disclosure, and do not represent all the technical spirit of the present disclosure, it should be understood that there may be many equivalents and modifications capable of substituting them at the time of filing the present application.

What is claimed is:

1. A unit bracket in a square shape, the unit bracket comprising:

four sides with outer surfaces, each of the four sides formed with locking projections configured to be coupled with a metal or plastic panel, and a center portion formed with a circular mesh part, wherein the unit bracket and a wall or a base material are configured to be bonded with an adhesive, in order to fix the unit bracket to the wall or the base material, and wherein corner mesh parts are formed in an arc shape centered about square corners of the unit bracket, and formed to maximize a bonding force when bonded to the wall or the base material with the adhesive.

2. The unit bracket of claim 1, wherein the outer surfaces of the four sides of the unit bracket have coupling projection parts formed on adjacent two side parts, the coupling projection parts protrude outwardly from the adjacent two side parts, coupling groove parts are formed in other side parts, and the coupling groove parts are formed from outward sides of the other side parts into an inward direction for coupling adjacent brackets respectively.

3. The unit bracket of claim 2, wherein each of the coupling projection parts has concave parts by extensions of walls from a center portion of the coupling projection parts such that wires pass therethrough an outer surface of each of the coupling projection parts has an arc shape, and coupling groove parts of the adjacent unit brackets coupled to the coupling projection parts also have arc shapes corresponding to the coupling projection parts for coupling the coupling projection parts.

4. The unit bracket of claim 1, wherein the mesh part comprises a central mesh part body with linear mesh parts and annular mesh parts which connect inner space parts of the central mesh part body, the linear mesh parts and the annular mesh parts are formed to be spaced upwards from a bottom part of the central mesh part body such that a space is formed for the adhesive to be injected between the linear mesh parts and the annular mesh parts at the bottom part of the central mesh part body, and when the unit bracket is bonded to the wall or the base material, the adhesive is injected from above into a lower surface between the wall or the base material, and the linear mesh parts and the annular mesh parts and the wall or the base material and the mesh part are integrated, thereby strengthening a bonding force.

5. A set bracket comprising:

four unit brackets arranged in a square shape, each outer surface of four sides of the unit brackets formed with locking projections configured to be coupled with a metal or plastic panel, each of the unit bracket including a center portion formed with a circular mesh part, wherein a wall or a base material is configured to be bonded to the mesh part of each of the unit bracket with an adhesive in order to fix the bracket to the wall or the base material, and wherein corner mesh parts are formed in an arc shape centered around square corners of the bracket, and formed to maximize a bonding force when bonded to the wall or the base material with the adhesive.

6. The bracket of claim 5, wherein the outer surfaces of the four sides of the bracket have coupling projection parts formed on adjacent two side parts, the coupling projection parts protrude outwardly from the adjacent two side parts, coupling groove parts are formed in the other two side parts, and the coupling groove parts are formed from outward sides of the other side parts into an inward direction for coupling adjacent brackets respectively.

7. The bracket of claim 6, wherein the coupling projection parts have concave parts by extensions of walls form center portions of the coupling projection part such that wires pass therethrough, outer surfaces of the coupling projection parts have configurations in an arc shape, and coupling groove parts of the adjacent brackets coupled to the coupling projection parts also have arc shapes corresponding to the coupling projection parts for coupling the coupling projection parts.

8. The bracket of claim 5, wherein the mesh part comprises a central mesh part body with linear mesh parts and annular mesh parts which connect inner space parts of the central mesh part body, the linear mesh parts and the annular mesh parts are formed to be spaced the adhesive is injected between the linear mesh parts and the annular mesh parts at the bottom part of the central mesh part body, and when the bracket is bonded to the wall or the base material, the adhesive is injected from above into a lower surface between the wall or the base material, and the linear mesh parts and the annular mesh parts and the wall or the base material and the mesh part are integrated, thereby strengthening a bonding force.

* * * * *